US010964233B2

(12) United States Patent
Durant

(10) Patent No.: US 10,964,233 B2
(45) Date of Patent: Mar. 30, 2021

(54) DEVICES, SYSTEMS, AND METHODS FOR DISPLAYING VISUAL FEATURES

(71) Applicant: Silas Jeffrey Durant, Scottdale, GA (US)

(72) Inventor: Silas Jeffrey Durant, Scottdale, GA (US)

( * ) Notice: Subject to any disclaimer, the term of this patent is extended or adjusted under 35 U.S.C. 154(b) by 0 days.

(21) Appl. No.: 15/268,092

(22) Filed: Sep. 16, 2016

(65) Prior Publication Data

US 2017/0084208 A1 Mar. 23, 2017

Related U.S. Application Data

(60) Provisional application No. 62/220,512, filed on Sep. 18, 2015.

(51) Int. Cl.

| | |
|---|---|
| ***G09F 7/04*** | (2006.01) |
| ***G09F 7/18*** | (2006.01) |
| ***G09F 15/00*** | (2006.01) |
| ***A47G 1/06*** | (2006.01) |
| ***A47G 1/14*** | (2006.01) |

(52) U.S. Cl.

CPC ..... *G09F 7/04* (2013.01); *A47G 1/065* (2013.01); *A47G 1/14* (2013.01); *G09F 7/18* (2013.01); *G09F 15/0068* (2013.01); *A47G 2001/0661* (2013.01); *A47G 2001/0672* (2013.01); *A47G 2001/145* (2013.01); *G09F 2007/1891* (2013.01)

(58) Field of Classification Search

CPC ..... A47G 2001/0672; A47G 1/065

USPC ..... 40/711, 449, 729; 446/131

See application file for complete search history.

(56) References Cited

U.S. PATENT DOCUMENTS

| | | | | |
|---|---|---|---|---|
| 5,172,503 | A | 12/1992 | Dane et al. | |
| 6,054,968 | A | 4/2000 | De Matteo | |
| 7,154,363 | B2 * | 12/2006 | Hunts | H01F 7/0242 335/306 |
| 8,333,026 | B2 | 12/2012 | Southard | |
| 8,397,411 | B2 | 3/2013 | Russo et al. | |
| 2003/0056413 | A1 | 3/2003 | Wiemer et al. | |
| 2004/0077258 | A1 | 4/2004 | Vicentelli | |
| 2005/0193613 | A1 | 9/2005 | Faltesek | |
| 2006/0201039 | A1 | 9/2006 | Gilliland | |
| 2006/0218839 | A1 * | 10/2006 | Vineyard | A47G 1/06 40/796 |
| 2008/0204474 | A1 * | 8/2008 | Franco | A47G 1/065 345/634 |

(Continued)

OTHER PUBLICATIONS

U.S. Appl. No. 62/220,512, filed Sep. 18, 2015, Silas Jeffrey Durant.

(Continued)

*Primary Examiner* — Joanne Silbermann

(74) *Attorney, Agent, or Firm* — Ballard Spahr LLP

(57) ABSTRACT

Disclosed herein are devices, systems, and methods for selectively arranging a plurality of visual features. The systems and methods include the use of a plurality of display assemblies. Each display assembly can have a frame and at least one magnet operatively associated with the frame. Each display assembly can be configured for selective positioning relative to at least one other display assembly to establish a polar attraction between aligned magnets associated with the frames of adjacent display assemblies.

19 Claims, 18 Drawing Sheets

(56) References Cited

U.S. PATENT DOCUMENTS

| | | | | |
|---|---|---|---|---|
| 2009/0049727 | A1* | 2/2009 | Vincent | A47G 1/065 40/730 |
| 2010/0024271 | A1 | 2/2010 | Seidler | |
| 2010/0229439 | A1* | 9/2010 | Elliot | A47G 1/06 40/711 |
| 2012/0285060 | A1 | 11/2012 | Gross et al. | |
| 2013/0314184 | A1 | 11/2013 | Richards et al. | |
| 2015/0224806 | A1 | 8/2015 | Good-Man | |
| 2016/0135619 | A1* | 5/2016 | Shields | A47G 1/06 40/711 |

OTHER PUBLICATIONS

PCT, PCT/US2016/052157, Sep. 16, 2016, Silas Jeffrey Durant. International Search Report and Written Opinion dated Dec. 28, 2016 by the International Searching Authority for International Application No. PCT/US2016/052157, which was filed on Sep. 16, 2016 (Applicant—Silas Jeffrey Durant.) (21 pages).

* cited by examiner

DEVICES, SYSTEMS, AND METHODS FOR DISPLAYING VISUAL FEATURES

CROSS-REFERENCE TO RELATED APPLICATIONS

This application claims priority to and the benefit of U.S. Provisional Patent Application Ser. No. 62/220,512, filed Sep. 18, 2015, which application is hereby incorporated by reference herein in its entirety.

FIELD

The present invention is related to devices, systems, and methods for selectively displaying visual features. More specifically, systems and methods are provided for selectively positioning at least two display assemblies relative to each other as desired by the user.

BACKGROUND

Various types of frames (e.g., collage frames) have been used to display images and other visual features. For example, groups of frames have been positioned in clusters or groups to create a desired visual effect. However, to secure these frames in a desired orientation, each frame must be permanently secured to a wall (or other surface) and optionally, must be permanently secured to another frame. Thus, after the frames are secured in the desired orientation, it is difficult and time-consuming to rearrange the frames, leaving the user with little discretion as to the orientation of the frames and the overall size and shape of the display created by the frames.

Accordingly, there remains a need for devices and systems for selectively arranging a plurality of visual features in an orientation as determined by the user. This need and other needs are satisfied by the various aspects of the present disclosure.

SUMMARY

Disclosed herein, in various aspects, are devices, systems, and methods for selectively arranging a plurality of visual features.

In one aspect, disclosed herein are display assemblies for displaying at least one visual feature. In this aspect, the display assembly can comprise a frame. The frame can have an outer edge and an inner edge. The outer edge of the frame can define a perimeter of the frame. The inner edge of the frame can define a central opening. The central opening can be configured to receive at least one visual feature of a plurality of visual features. In another aspect, each display assembly of the plurality of display assemblies can have at least one magnet that can be operatively associated with the frame. In another aspect, each display assembly of the plurality of display assemblies can be configured for selective positioning relative to at least one other display assembly to establish a polar attraction between aligned magnets associated with the frames of adjacent display assemblies.

In another aspect, described herein are systems for selectively arranging a plurality of visual features that can comprise a plurality of display assemblies. In one aspect, each display assembly of the plurality of display assemblies can have a frame. The frame can have an outer edge and an inner edge. The outer edge of the frame can define a perimeter of the frame. The inner edge of the frame can define a central opening. The central opening can be configured to receive at least one visual feature of the plurality of visual features. In another aspect, each display assembly of the plurality of display assemblies can have at least one magnet that can be operatively associated with the frame. In another aspect, each display assembly of the plurality of display assemblies can be configured for selective positioning relative to at least one other display assembly to establish a polar attraction between aligned magnets associated with the frames of adjacent display assemblies.

In another aspect, described herein are methods for selectively arranging a plurality of visual features. In one aspect, the method can comprise positioning a plurality of display assemblies onto a surface. In this aspect, each display assembly of the plurality of display assemblies can comprise a frame. The frame can have an outer edge and an inner edge. The outer edge of the frame can define a perimeter of the frame. The inner edge of the frame can define a central opening. The central opening can be configured to receive at least one visual feature of the plurality of visual features. In another aspect, each display assembly of the plurality of display assemblies can have at least one magnet that can be operatively associated with the frame. In another aspect, each display assembly of the plurality of display assemblies can be configured for selective positioning relative to at least one other display assembly to establish a polar attraction between aligned magnets associated with the frames of adjacent display assemblies. In another aspect, the method can comprise selectively arranging each display assembly of the plurality of display assemblies relative to at least one other display assembly. In another aspect, each display assembly of the plurality of display assemblies can be configured for selective positioning relative to at least one other display assembly to establish a polar attraction between aligned magnets associated with the frames of adjacent display assemblies.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

The accompanying drawings, which are incorporated in and constitute a part of this specification, illustrate several aspects of the invention and together with the description, serve to explain the principles of the invention.

FIG. 13A depicts an exemplary magnet having an axial dual polarity, while FIG. 13B depicts an exemplary magnet having a diametric dual polarity.

DETAILED DESCRIPTION

Figure 1:
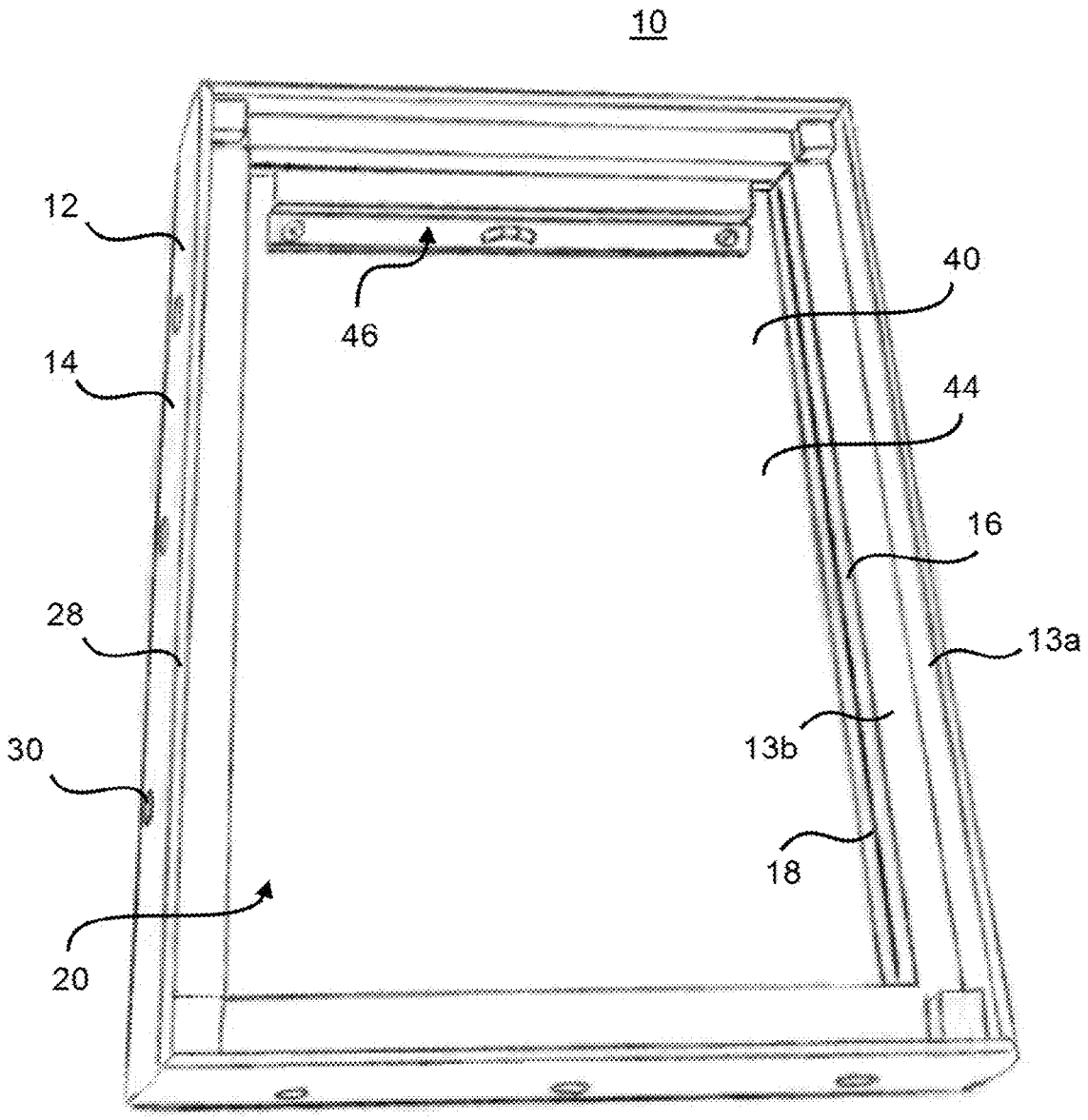
FIG. 1 is a rear perspective view of an exemplary display assembly as disclosed herein.

The present invention can be understood more readily by reference to the following detailed description, examples, drawings, and claims, and their previous and following descriptions. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a display assembly" can include two or more such display assemblies unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The terms "first," "second," "first part," "second part," and the like, as used herein, do not denote any order, quantity, or importance, and are used to distinguish one element from another, unless specifically stated otherwise.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Described herein, in various exemplary embodiments and with reference to FIGS. 1-30, is a display assembly 10 for displaying one or more visual features 22. In exemplary aspects, the display assembly 10 can comprise a frame 12. In one aspect, the frame 12 can have an outer edge 14. In another aspect, the frame 12 can have an inner edge 16. In a further aspect, the outer edge 14 of the frame 12 can define a perimeter of the frame 12. In still a further aspect, the inner edge 16 of the frame 12 can define a central opening 20. It is contemplated that the central opening 20 can be configured to receive at least one visual feature 22 of a plurality of visual features 22. It is contemplated that the at least one visual feature 22 can comprise an image, text (letters, phrases, sentences, paragraphs, and the like), a document, an object, or combinations or portions thereof. The images can be any graphic, such as a piece of artwork (i.e., a painting, a photograph, a sketch, or collage, etc.). For example, in some exemplary aspects, it is contemplated that visual features 22 can be manually positioned within the central openings 20 of frames 12 as further disclosed herein.

Optionally, in exemplary aspects, it is contemplated that at least one visual feature 22 can be displayed digitally using a video display, such as, for example and without limitation, an electronic paper display, a plastic electronic display, a LCD video display, or an electrowetting display as are known in the art. In one aspect, the frame 12 can define the video display. In another aspect, the video display can comprise at least a portion of the frame 12. In one aspect, the video display can be flexible. In another aspect, the video display can have a selected cross-sectional profile, such as, for example and without limitation, a concave, a convex, or a substantially planar cross-sectional profile. In another aspect, the video display can have a desired shape, such as, for example and without limitation, a three-dimensional polygonal shape. One skilled in the art would appreciate that such digital video displays can comprise a programmable memory such that the user can display a slideshow of multiple visual features. The programmable memory can comprise a built-in memory and/or a memory card slot that allows the user to increase the storage capacity. The digital display can show JPEG, BMP, and TIFF images, as well as any other images having a suitable format. Optionally, the digital video display can comprise a built-in speaker allowing the user to play MP3 and WAV audio files. As is known to one skilled in the art, the speaker can be a mono or stereo speaker. Optionally, in exemplary aspects, the digital display can be configured to display video files such as, but not limited to, M-JPEG, WMA, AVI, and MPEG-1, 2, and 4 video files. In one aspect, the digital display can comprise touch-screen controls as are known in the art. In another aspect, the video display can comprise software that allows the user to operate the video display using a computer, a cellular device, and/or a remote control device. In operation, it is contemplated that the user can control each respective video display from a remote location. In a further aspect, the video display can provide various playback speeds. In another aspect, the video display can be configured to display selected transition patterns when the video display transitions from displaying a first visual feature to a second visual feature. In yet another aspect, the video display can display random slideshows or, alternatively, the user can create a playlist containing specific images of the user's choice. In another aspect, the digital display can comprise internal memory. In another aspect, the digital display can comprise a USB port and/or a card reader as are known in the art. As is known in the art, a user can connect the video display to a computer, a cellular device, a flash drive, an external hard drive, and/or a memory card using the USB port and/or the card reader to transfer image files and/or audio files from the computer, cellular device, flash drive, external hard drive, memory card to the digital display. In another aspect, the digital display can be configured to establish Wi-Fi and/or Bluetooth connectivity with an external device. Such Wi-Fi and/or Bluetooth connectivity allows the user to connect the video display to a network, a computer and/or cellular device in a wireless manner as is known in the art. It is contemplated that the video display can be linked to a user's social media website, such as, but not limited to, Facebook, Twitter, and/or Instagram, such that images and/or videos uploaded to the social media website can appear on the video display.

As shown in FIGS. 1-30, the frame 12 of the display assembly 10 can have a front surface 26 and an opposed back surface 28. In this aspect, the front and back surfaces 26, 28 of the frame 12 can extend between the inner and outer edges 16, 14 of the frame 12 of the display assembly 10. In these aspects and as shown in FIG. 14, FIG. 15, FIG. 17, and FIGS. 18A-18C, the frame can comprise a housing portion 24 that is at least partially bounded by or defined by the inner and outer edges 16, 14 and the front and back surfaces 26, 28 of the frame 12. Optionally, the frame 12 can define the housing portion 24; however, it is also contemplated that the housing portion 24 can be a separate component that is selectively secured to portions of the frame. In further aspects, the housing portion 24 can define or comprise at least one receptacle 15 that can extend outwardly from the inner edge 16 of the frame 12 toward the outer edge 14. Alternatively, it is contemplated that the at least one receptacle 15 can extend inwardly from the outer edge 14 of the frame 12 toward the inner edge 16. In one aspect, it is contemplated that the at least one receptacle 15 can define respective voids 114 that are configured to receive at least one magnet 30 as further disclosed herein. It is further contemplated that the at least one magnet 30 can be positioned inside a receptacle of the at least one receptacle 15. In another aspect, the at least one receptacle 15 can comprise any shape known in the art that can maintain the at least one magnet 30 in an operative position, including without limitation, a ring-shape, a cylindrical shape, a disc shape, a block shape, a spherical shape, an oval shape, and the like. In a preferred exemplary embodiment, the at least one receptacle 15 is oval-shaped. In still further aspects, the housing portion 24 can define at least one aperture or slot 36 that can extend outwardly from the inner edge 16 of the frame 12 toward the outer edge 14. Alternatively, it is contemplated that the at least one aperture or slot 36 can extend inwardly from the outer edge 14 of the frame 12 toward the inner edge 16.

Figure 16:
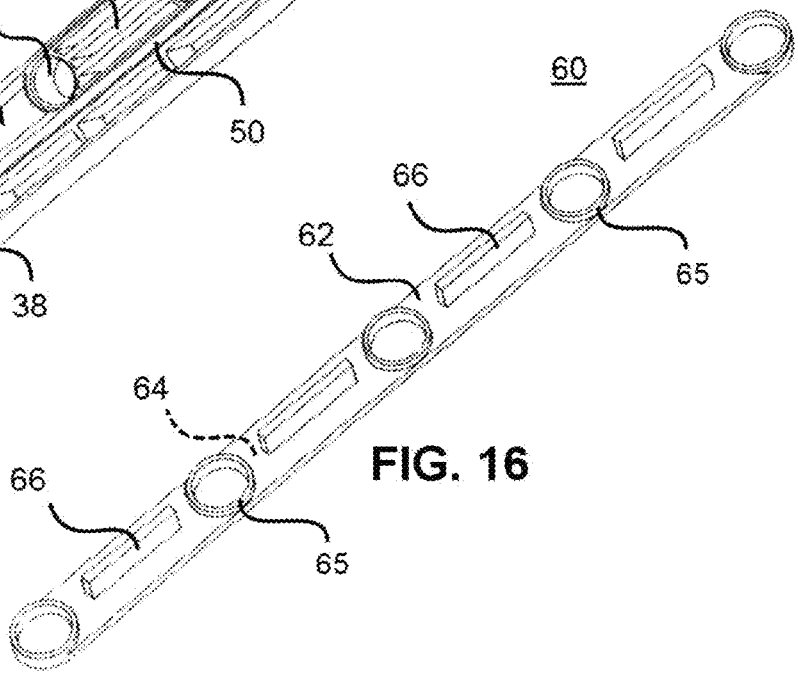
FIG. 16 is an isometric view of an exemplary frame cover as disclosed herein.
Figure 17:
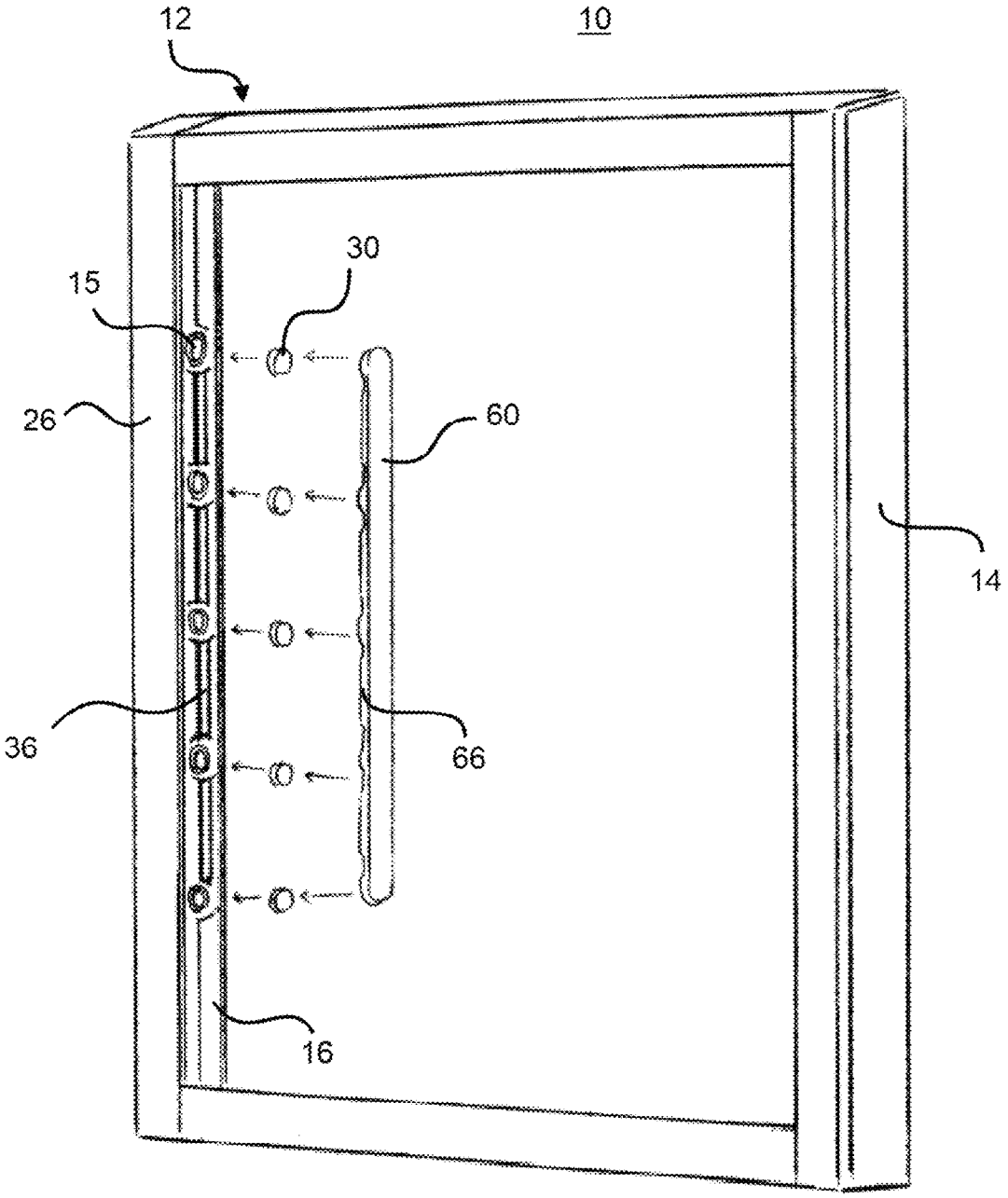
FIG. 17 is a front perspective view of an exemplary display assembly, showing a plurality of magnets being positioned inside a corresponding receptacle as disclosed herein. Also shown is an exemplary frame cover being coupled to a portion of the inner edge of the frame, thereby supporting the plurality of magnets in an operative position relative to (and within) the receptacles.
Figure 18A:
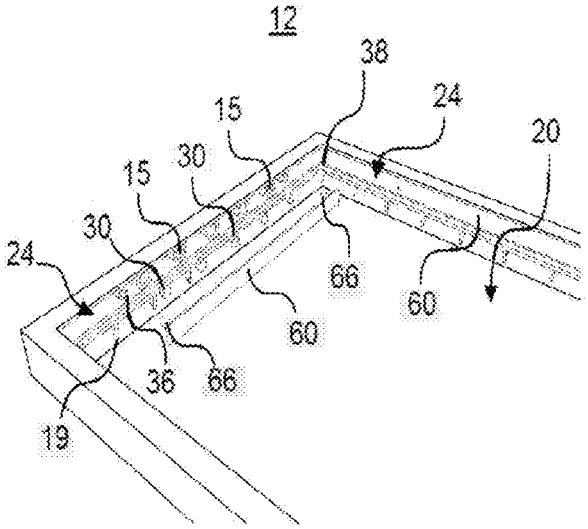
FIG. 18A is a perspective view of another exemplary display assembly, showing a plurality of magnets being positioned inside corresponding receptacles as disclosed herein.
Figure 18B:
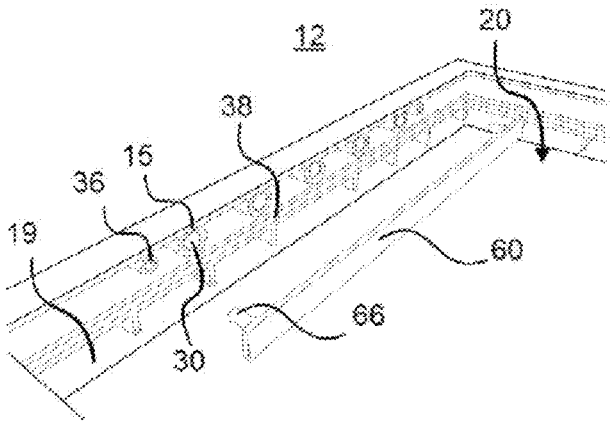
FIG. 18B is a perspective view of the exemplary display assembly of FIG. 18A, showing the plurality of magnets positioned inside the corresponding receptacles as disclosed herein.

In exemplary aspects, and with reference to FIG. 16, FIG. 18A, and FIG. 18B, the display assembly 10 can comprise a frame cover 60 selectively positionable to secure the plurality of magnets in an operative position within the receptacles 15. In these aspects, the frame cover 60 can have an inner surface 62 and an opposing outer surface 64. In further aspects, the frame cover 60 can comprise at least one connecting member 66 disposed on a portion thereof. In these aspects, the at least one connecting member 66 can be disposed on the inner surface 62 of the frame cover 60 and can extend outwardly from the inner surface 62 of the frame cover 60.

In another aspect, as shown in FIGS. 14-17 and FIG. 18C, the frame cover 60 can be selectively coupled to at least a portion of the inner edge 16 of the frame 12 (where the receptacles 15 and apertures or slots 36 extend outwardly from the inner edge 16) or to at least a portion of the outer edge 14 of the frame 12 (where the receptacles 15 and apertures or slots 36 extend inwardly from the outer edge 14 of the frame). In this aspect, the at least one aperture 36 can be configured to receive the at least one connecting member 66 of the frame cover 60. In a further aspect, the at least one connecting member 66 can be coupled to the at least one aperture 36, thereby securing the frame cover 60 to the inner edge 16 of the frame 12 (or the outer edge of the frame). In these aspects, the frame cover 60 can be configured to secure the at least one magnet 30 that is operatively associated with the at least one receptacle 15. In further aspects, it is contemplated that the at least one connecting member 66 can comprise a projection shaped and sized for receipt within the at least one aperture or slot 36 of the frame 12. Alternatively, it is also contemplated that the at least one connecting member 66 can comprise a projection shaped and sized for selective coupling to portions of the inner edge 16 of the frame 12 (or outer edge 14 of the frame) that surround the apertures 36. In exemplary aspects, a plurality of receptacles 15 can be spaced axially along the inner edge 16 of the frame 12 (or outer edge 14 of the frame), with apertures or slots 36 being positioned axially between sequential receptacles. In these aspects, it is contemplated that the frame cover 60 can define axially spaced lip portions 65 that are configured for complementary receipt within (and, optionally, engagement with) corresponding receptacles 15 of the inner edge 16 of the frame 12 (or the outer edge of the frame). Optionally, each lip portion 65 can define a circumferential lip that has an outer diameter that is less than the outer diameter of the receptacles 15 of the inner edge 16 of the frame 12 (or the outer edge 14 of the frame 12). It is further contemplated that the projections 66 of the frame cover 60 can be positioned between sequential lip portions 68 along the axial length of the frame cover. Optionally, it is contemplated that the frame cover 60 (or the connecting members 66 of the frame cover) and the inner edge 16 of the frame 12 (or the outer edge 14 of the frame 12) can comprise any conventional fastener 68 known in the art, including without limitation, a dowel, an inter-locking connecting shape, an adhesive, a hook and loop fastener (e.g., VELCRO), a grommet, a snap, a button, a press stud, a snap button, or combinations thereof.

In one aspect, it is contemplated that the frame 12 of the display assembly 10 can comprise any shape. Such shapes can include substantially circular, substantially rectangular, substantially square, substantially triangular, substantially heart-shaped, and the like. In another aspect, the frame 12 of the display assembly 10 can be of any size. For example and without limitation, the size of the frame 12 of the display assembly 10 can be 4"×6", 4×7, 4×12, 5×5, 5"×7", 7×7, 8×8, 8"×10", 8.5×11, 8×12, 9×12, 10×13, 10×20, 11"×14", 11"×17", 12"×12", 12"×16", 12"×18", 13"×19", 14"×18", 12"×36", 16"×20", 18"×24", 20"×24", 20"×28", 22"×28", 24"×30", 27"×39", 27"×40", or 27"×41" (all measurements are provided in inches). In yet another aspect, the frame 12 of the display assembly 10 can comprise any color or a combination of colors. In another aspect, the frame 12 of the display assembly 10 can be clear or translucent. In another aspect, the frame 12 of the display assembly 10 can comprise wood, plastic, acrylic, vinyl, fabric, metal, stone, or combinations thereof. Optionally, in some exemplary aspects and as shown in FIGS. 1 and 2B, the frame 12 can have a stepped configuration in which the frame has an outer frame portion 13*a* and an inner frame portion 13*b* that is recessed relative to the outer frame portion such that the inner frame portion 13*b* has a cross-sectional thickness that is less than a cross-sectional thickness of the outer frame portion 13*a*. In these optional aspects, it is contemplated that the inner frame portion 13*b* can define the central opening 20.

Figures 11A, 11B, 11C, 11D:
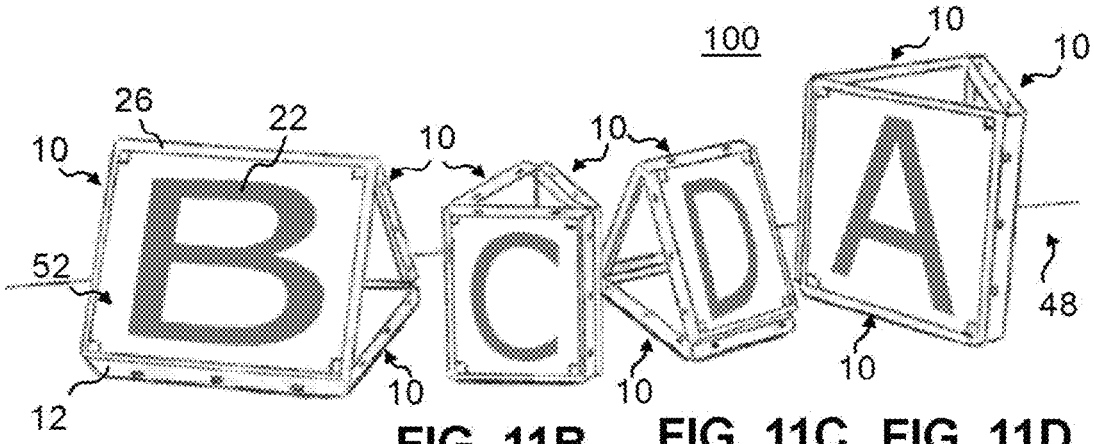
FIGS. 11A-11D are perspective views of various exemplary folded configurations of a plurality of display assemblies as disclosed herein.
Figure 12:
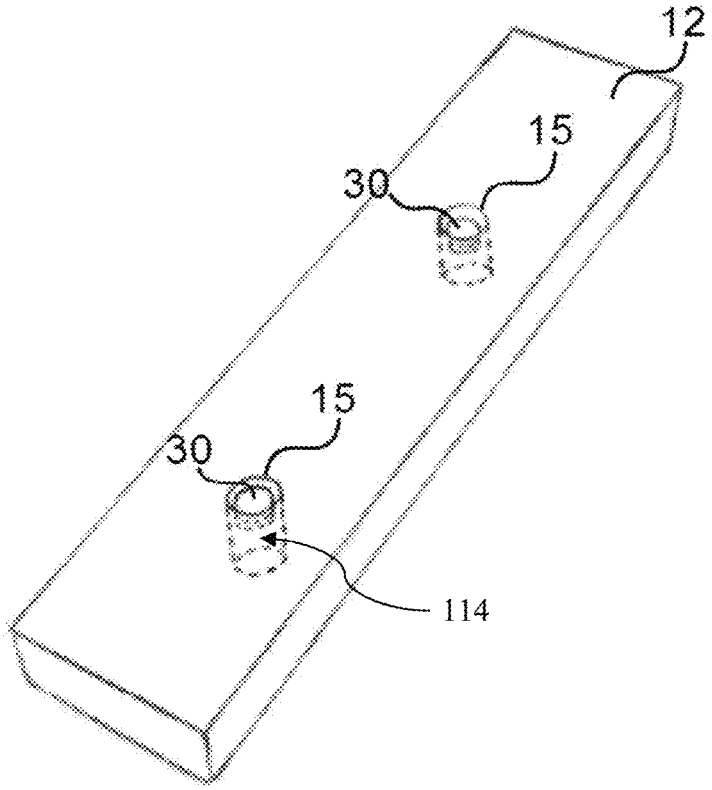
FIG. 12 is a perspective view of a portion of a frame of a display assembly having at least one dual polarity magnet operatively associated with the frame as disclosed herein.
Figure 26A:
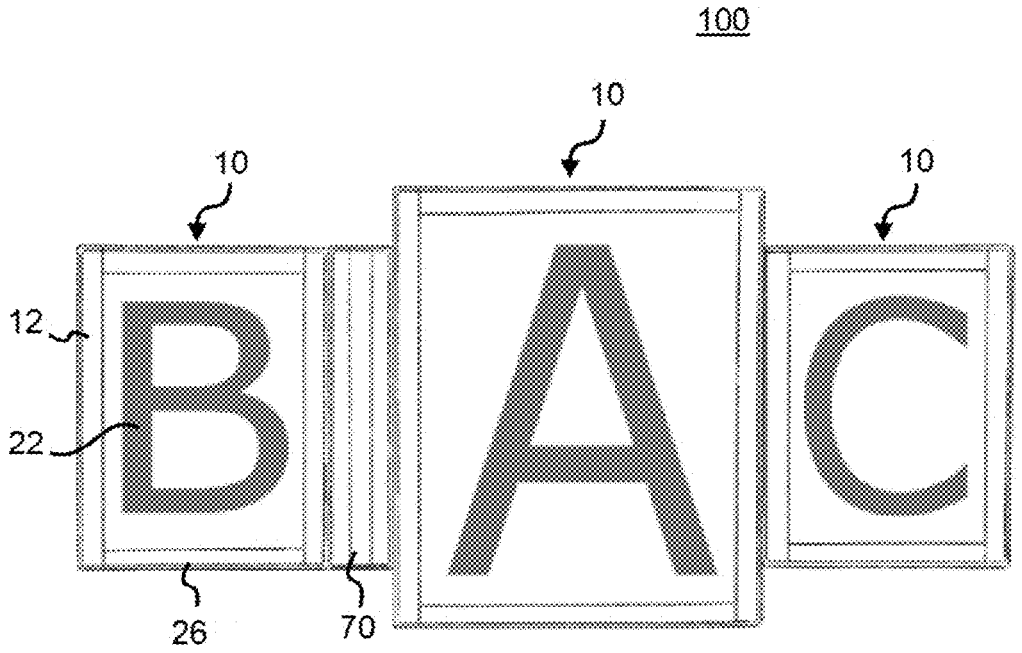
FIG. 26A is a front view of an exemplary configuration of a plurality of display assemblies, showing at least one display assembly (right) of the plurality of display assemblies selectively positioned adjacent to at least one other display assembly (middle). Further shown is at least one display assembly (left) of the plurality of display assemblies spaced apart from at least one other display assembly (middle) by a spacer as described herein.
Figure 26B:
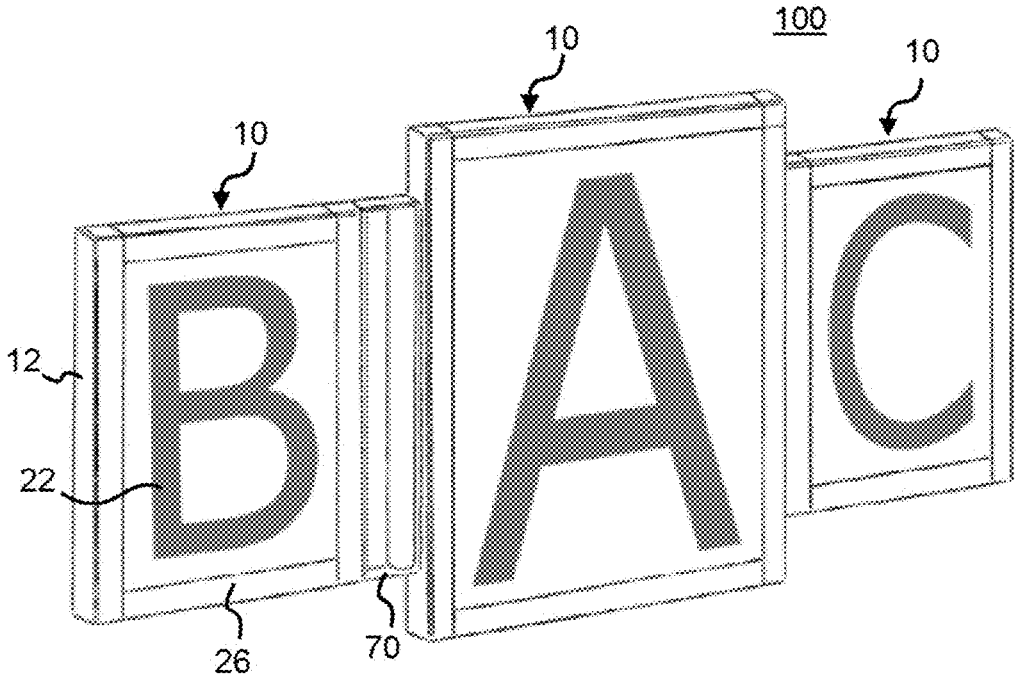
FIG. 26B is a front perspective view of the exemplary configuration of the plurality of display assemblies of FIG. 26A.
Figure 27:
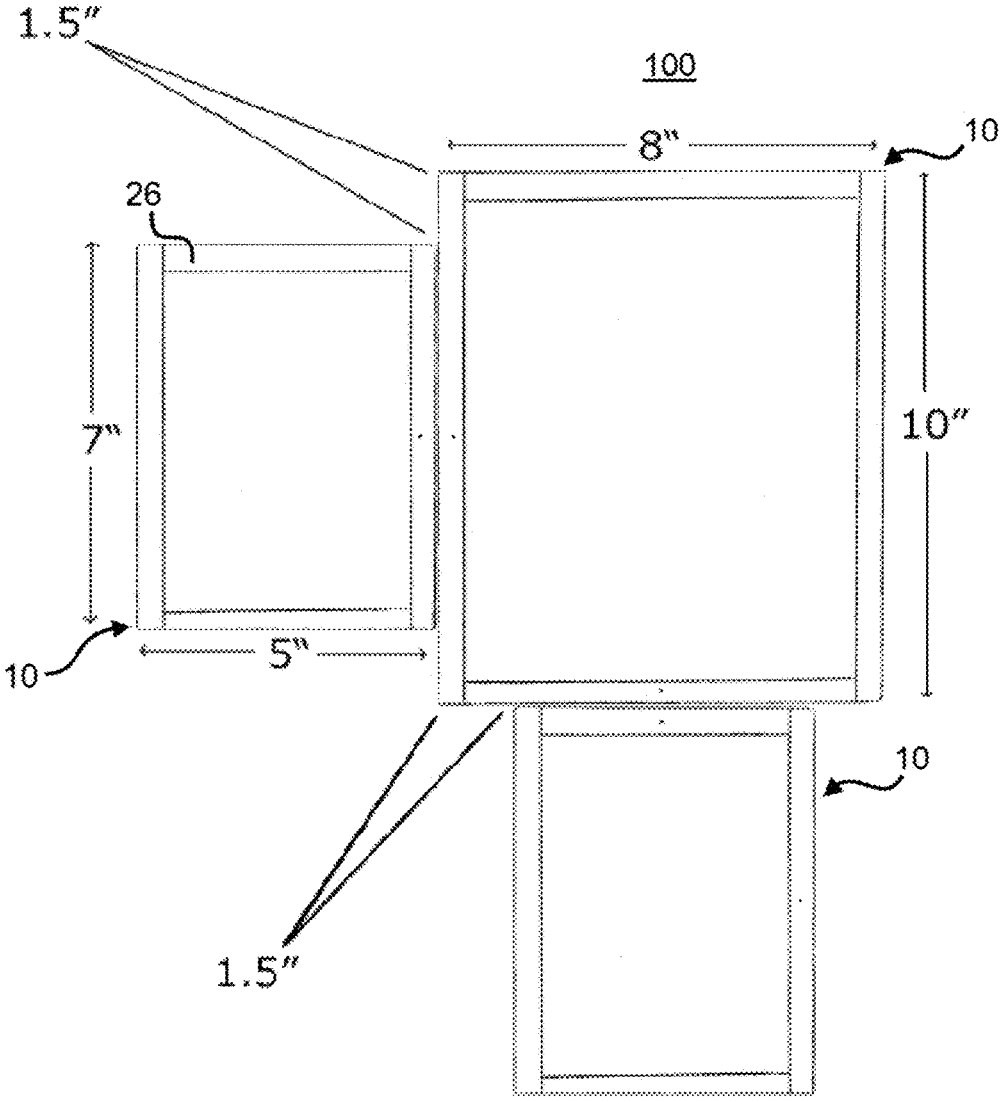
FIG. 27 is a front view of another exemplary configuration of a plurality of display assemblies, showing frames of varying dimensions as described herein.

In another aspect, and as shown in FIGS. 1-30, the display assembly 10 can comprise at least one magnet 30 that can be operatively associated with the frame 12. In one aspect, the at least one magnet 30 of the display assembly 10 can comprise one or more magnets that can be operatively associated with the outer edge 14 of the frame 12 of the display assembly 10. In another aspect, and with reference to FIGS. 8-9, the at least one magnet 30 of the display assembly 10 can comprise one or more front magnets (not shown) that can be operatively associated with the front surface 26 of the frame 12 of the display assembly 10. In yet another aspect, and with reference to FIGS. 8-9, the at least one magnet 30 of the display assembly 10 can comprise one or more rear magnets (not shown) that can be operatively associated with the back surface 28 of the frame 12 of the display assembly 10. Optionally, the at least one magnet 30 of the display assembly 10 can comprise both front and rear magnets as disclosed herein. It is contemplated that the at least one magnet 30 of the display assembly 10 can be embedded within the frame 12 of the display assembly 10. Optionally, in one aspect, and as shown in FIG. 12, the at least one magnet 30 can comprise at least one magnet 30 (optionally, a dual polarity magnet 34 as further disclosed herein) positioned within a receptacle 15 defined within the frame 12 of the display assembly 10. It is contemplated that the at least one magnet 30 can comprise a plurality of magnets. In this aspect, the plurality of magnets can be spaced from one another about a portion of the frame 12 of a display assembly 10. Optionally, the plurality of magnets can be spaced apart from one another based on the relative proportional lengths of adjacent display assemblies. It is contemplated that such placement of the plurality of magnets can increase the number of center to center, and corner to corner attachment points of adjacent frames. For example and without limitation, the plurality of magnets 30 can be spaced a distance ranging from about 1 inch to about 2 inches from one another (i.e., each magnet is axially spaced from sequential magnets along the axial length of an edge of the frame by a distance ranging from about 1 inch to about 2 inches). More particularly, as shown in FIG. 27, the plurality of magnets 30 can be optionally spaced a distance of about 1.5 inches from one another. It is further contemplated, for example and without limitation, that when the frames of adjacent first and second display assemblies are coupled to one another such that the magnets of the first display assembly are in communication with the magnets of the second display assembly, the distance between corresponding (optionally, aligned) magnets of the coupled edges of the first and second display assemblies can be in the range of about 1 inch to about 2 inch, or optionally about 1.5 inches. Optionally, the magnets can be substantially centered relative to a width of each frame (between the inner and outer edges of the frame). It is further contemplated that the axial distance from a center point of each magnet to the inner and outer edges of the frame can range from about 0.5 to about 1.0 inches or, optionally, be about 0.75 inches.

Figure 13A:
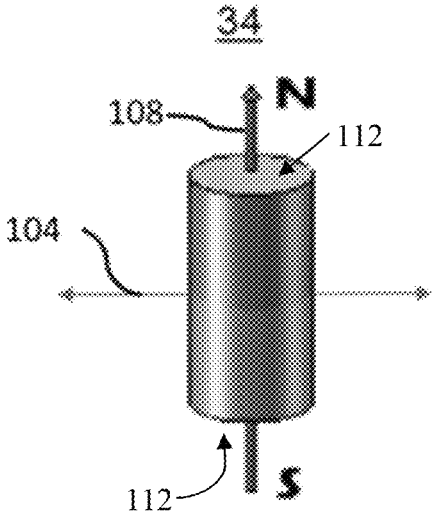
FIGS. 13A-13B depict exemplary configurations of a dual-polarity magnet as disclosed herein.

In some aspects, the at least one magnet 30 can comprise at least one magnet that is fixed to frame 12 such that it operates with a single polarity (e.g., only one pole of the magnet is exposed). Optionally, in these aspects, the at least one magnet 30 can comprise a plurality of single-polarity magnets that are operatively associated with the frame 12. In additional aspects, the at least one magnet 30 can comprise at least one dual polarity magnet that is associated with the frame 12 such that it can rotate, flip, or otherwise adjust its position to thereby adjust its operative polarity depending upon the polarity of an external magnetic force in proximity to the dual polarity magnet. It is contemplated that the at least one dual polarity magnet 34 can have an axial dual polarity as is known in the art in which the magnet has axially opposed poles along a longitudinal polar axis 108 (that extends along the length of the magnet between opposed planar faces 112) as shown in FIG. 13A. Alternatively, it is contemplated that the at least one dual polarity magnet 34 can have a diametric dual polarity as is known in the art in which the magnet has opposed poles along a transverse polar axis 108 (that extends along the thickness of the magnet and perpendicular to the length of the magnet). In use, each dual polarity magnet 34 can be configured to automatically adjust its orientation to establish a polar attraction with adjacent magnets as further disclosed herein. For example, the dual polarity magnet shown in FIG. 13A can flip about an axis 104 that is transverse to its polar axis 108 to thereby reverse its operative polarity. As another example, the dual polarity magnet shown in FIG. 13B can rotate about an axis 104 that is transverse to its polar axis 108 to thereby adjust its operative polarity. Optionally, the at least one magnet 30 can comprise a plurality of dual polarity magnets that are operatively associated with the frame 12. In some exemplary aspects, the at least one magnet 30 can comprise at least one single polarity magnet and at least one dual polarity magnet. Optionally, in these aspects, the at least one magnet 30 can comprise a plurality of single polarity magnets and a plurality of dual polarity magnets as disclosed herein. It is contemplated that any desired combination of single polarity magnets and dual polarity magnets can be used, with the single and dual polarity magnets being distributed as desired among the various surfaces of the frame. It is further contemplated that each magnet 30 (including the dual polarity magnets 34 disclosed herein) can have any desired shape, including, for example and without limitation, a ring-shape, a cylindrical shape, a disc shape, a block shape, a spherical shape, and the like.

Figure 5:
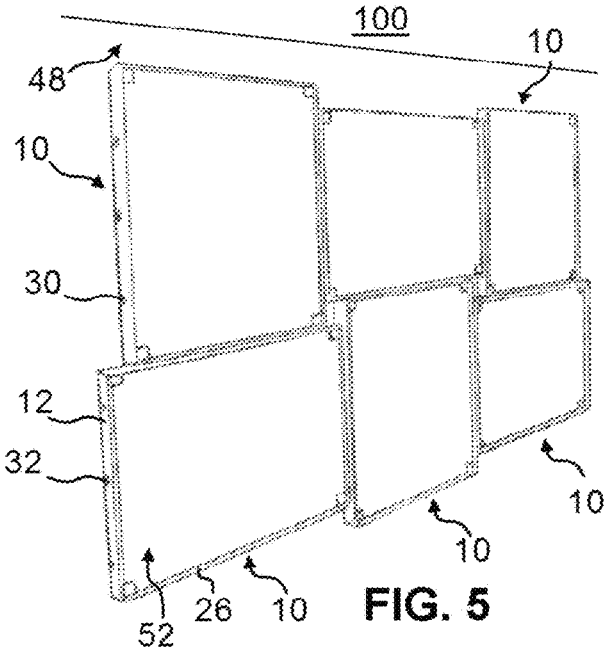
FIG. 5 is a front perspective view of another exemplary configuration of a plurality of display assemblies, showing each display assembly selectively positioned relative to at least one other display assembly and having outer surfaces connected by fasteners as disclosed herein.
Figure 6:
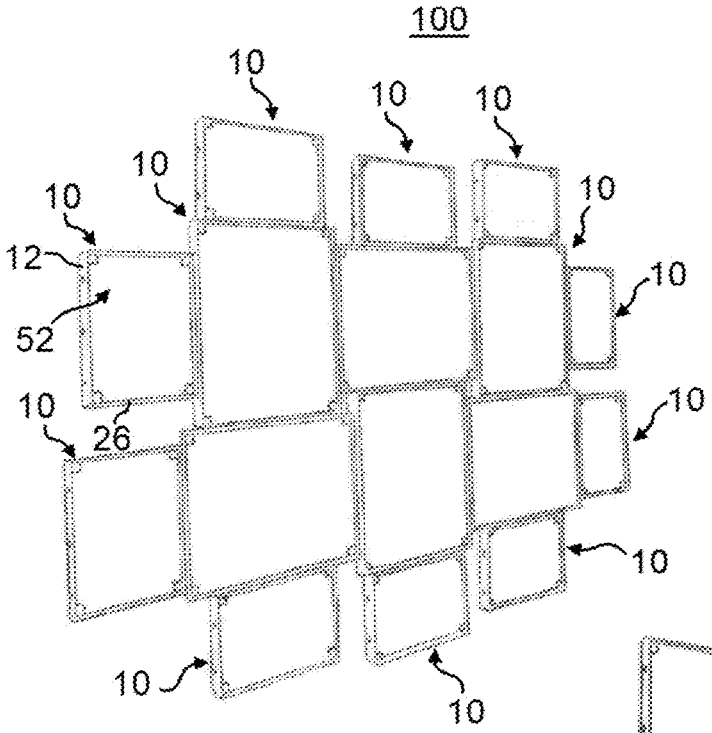
FIG. 6 is a front perspective view of another exemplary configuration of a plurality of display assemblies, showing each display assembly selectively positioned relative to at least one other display assembly and having magnetically connected outer surfaces as disclosed herein.
Figure 7:
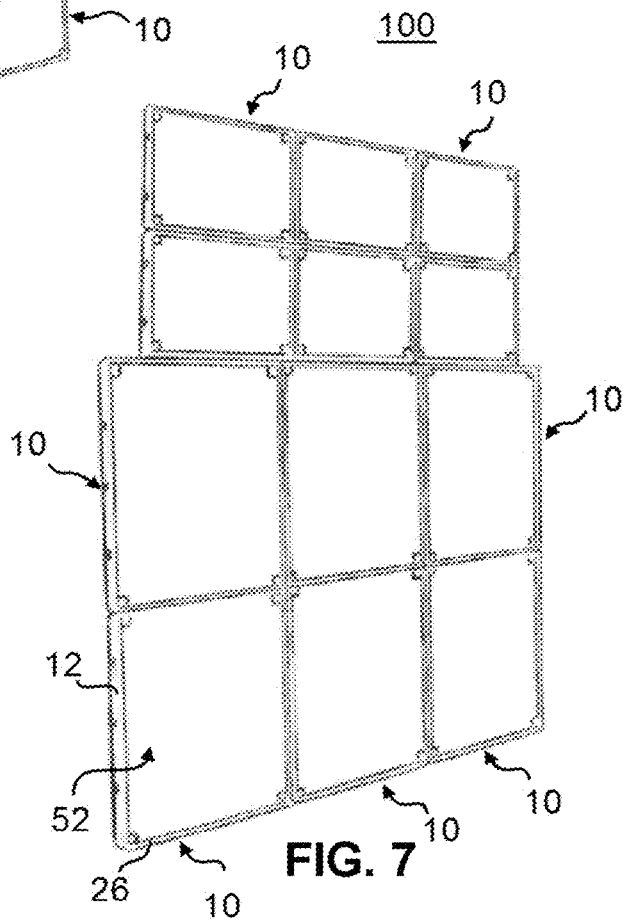
FIG. 7 is a front perspective view of another exemplary configuration of a plurality of display assemblies, showing each display assembly selectively positioned relative to at least one other display assembly and having magnetically connected outer surfaces as disclosed herein.
Figure 8:
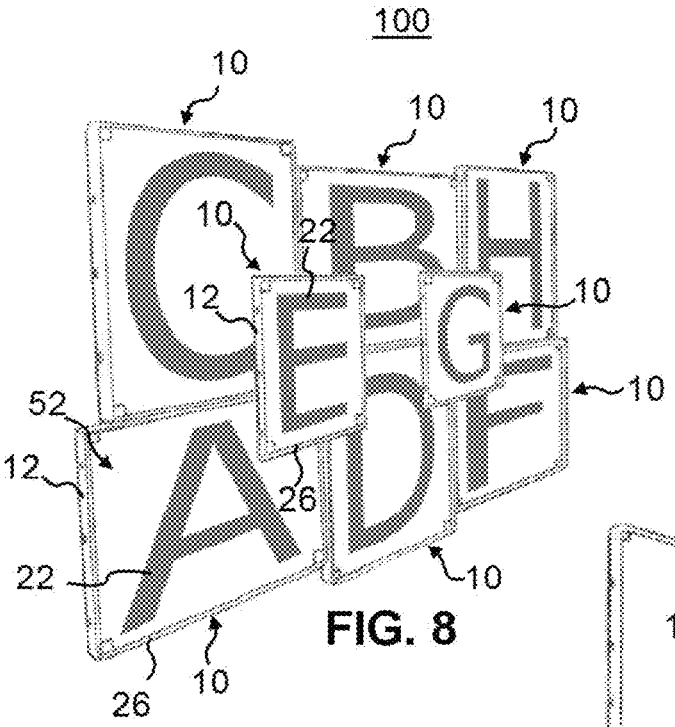
FIG. 8 is a front perspective view of an exemplary configuration of a plurality of display assemblies, showing each display assembly selectively positioned relative to at least one other display assembly, wherein the back surfaces of some display assemblies are magnetically connected to the front surfaces of other display assemblies.
Figure 9:
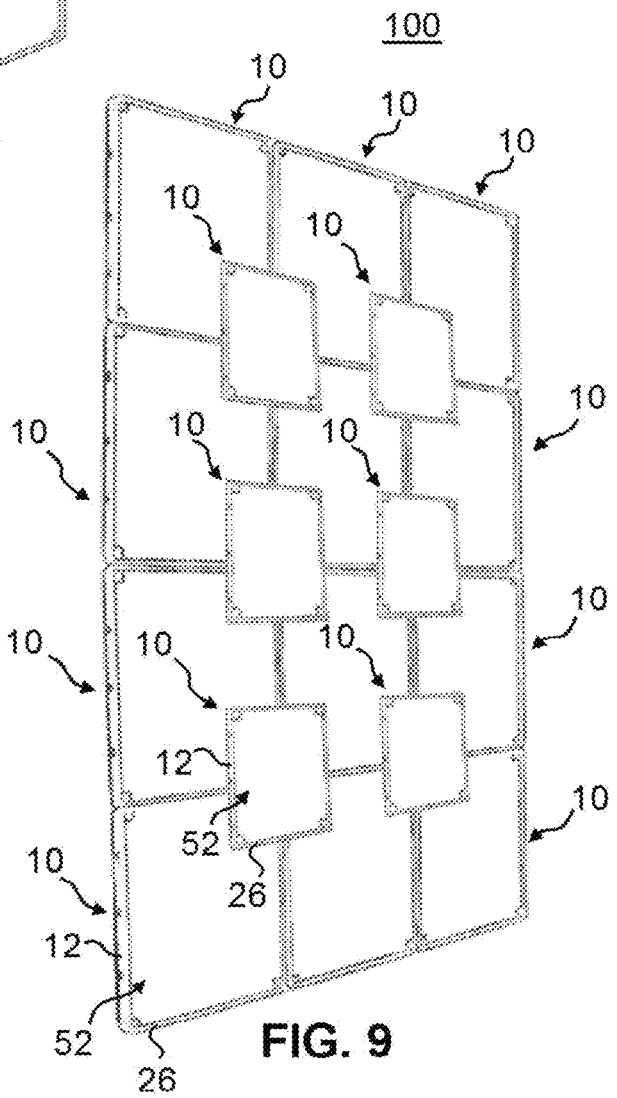
FIG. 9 is a front perspective view of another exemplary configuration of a plurality of display assemblies, showing each display assembly selectively positioned relative to at least one other display assembly, wherein the back surfaces of some display assemblies are magnetically connected to the front surfaces of other display assemblies.

In another aspect, as shown in FIG. 5, the display assembly 10 can comprise at least one fastener 32 (distinct from the magnets 30) that can be operatively associated with the frame 12. In one aspect, the at least one fastener 32 of the display assembly 10 can comprise one or more fasteners 32 that can be operatively associated with the outer edge 14 of the frame 12 of the display assembly 10. In another aspect, the at least one fastener 32 of the display assembly 10 can comprise one or more front fasteners (not shown) that can be operatively associated with the front surface 26 of the frame 12 of the display assembly 10. In yet another aspect, the at least one fastener 32 of the display assembly 10 can comprise one or more rear fasteners (not shown) that can be operatively associated with the back surface 28 of the frame 12 of the display assembly 10. Optionally, the at least one fastener 32 of the display assembly 10 can comprise both front and rear fasteners as disclosed herein. It is contemplated that the at least one fastener 32 of the display assembly 10 can be embedded within the frame 12 of the display assembly 10. Optionally, in one aspect, the at least one fastener 32 can comprise at least one fastener 32 positioned within a receptacle 15 defined within the frame 12 of the display assembly 10. It is contemplated that the at least one fastener 32 of the display assembly can comprise a dowel, an inter-locking connecting shape, an adhesive, a hook and loop fastener (e.g., VELCRO), a grommet, a snap, a button, a press stud, a snap button, or combinations thereof. However, it is contemplated that any conventional fastener can be used.

Figure 2A:
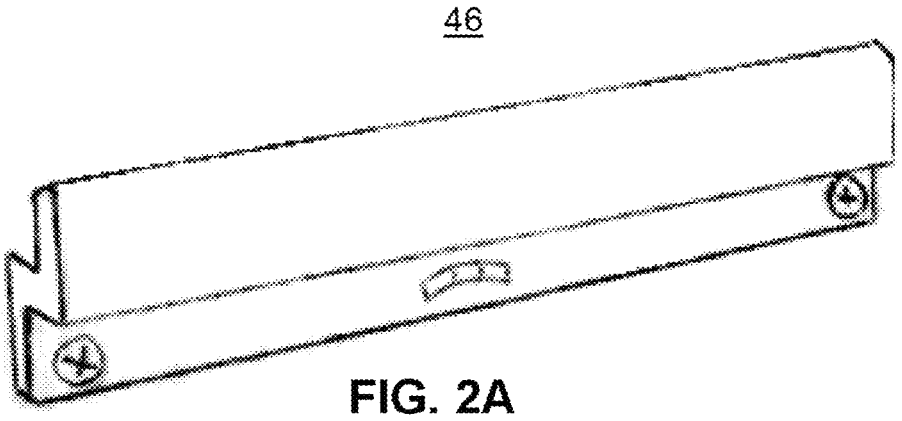
FIG. 2A is a perspective view of an exemplary support member that can be configured to secure a display assembly to a selected surface as disclosed herein.
Figure 2B:
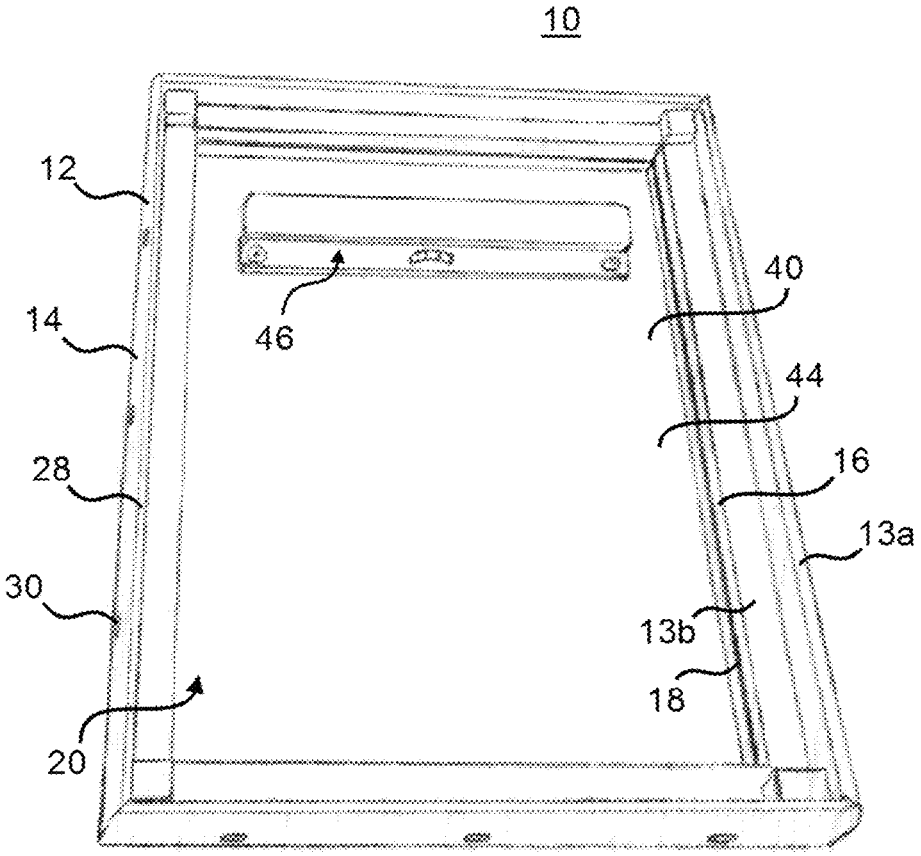
FIG. 2B is a rear perspective view of an exemplary display assembly showing the support member of FIG. 2A secured to the display assembly as disclosed herein.
Figure 18C:
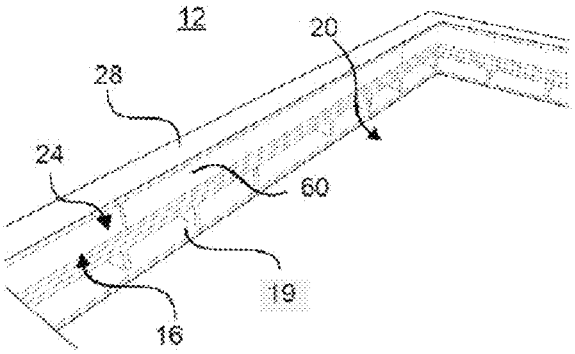
FIG. 18C is a perspective view of the exemplary display assembly of FIGS. 18A and 18B, showing a frame cover coupled to a portion of the inner edge of the frame, thereby supporting the plurality of magnets in an operative position relative to (and within) the receptacles.

Referring now to FIGS. 1-2B, in one optional aspect, the display assembly 10 can comprise a backing 40. The backing 40 can have a front wall 42 and an opposed back wall 44. It is contemplated that at least a portion of the backing 40 can be configured for selective operative coupling to the frame 12 of a respective display assembly. In exemplary aspects, the inner edge 16 of the frame can define at least one slit 18 or indentation that is configured to receive a portion of the backing 40 to thereby support the backing in an operative position. Alternatively, in one exemplary aspect, the inner edge 16 of the frame 12 can define a lip 19 or protrusion that can extend inwardly from the inner edge toward the central opening 20, as shown in FIGS. 18A-18C. In this aspect, the lip 19 can be configured to support the backing 40 in an operative position thereby preventing the backing from extending through the central opening 20 of the frame. Upon operative coupling of the backing 40 to the frame 12 of the display assembly 10, it is contemplated that at least a portion of the backing 40 can be positioned in communication with (optionally, within) the central opening 20.

Figure 19A:
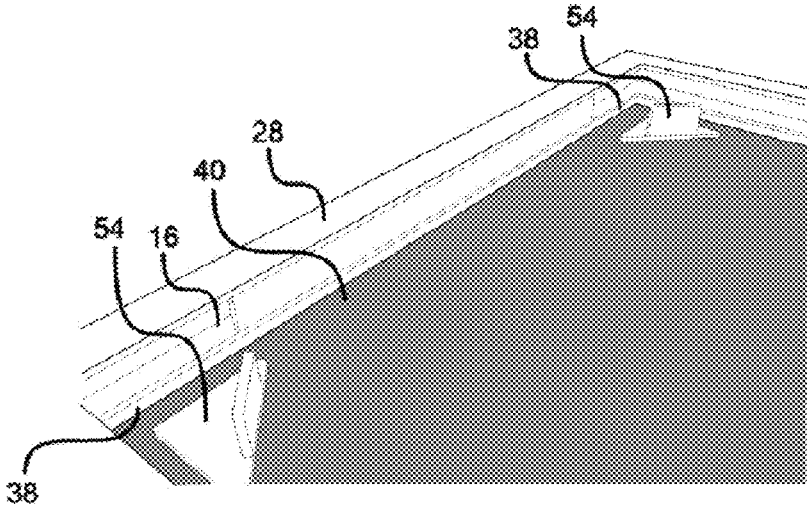
FIG. 19A is a rear perspective view of an exemplary display assembly having anchors as disclosed herein.
Figure 19B:
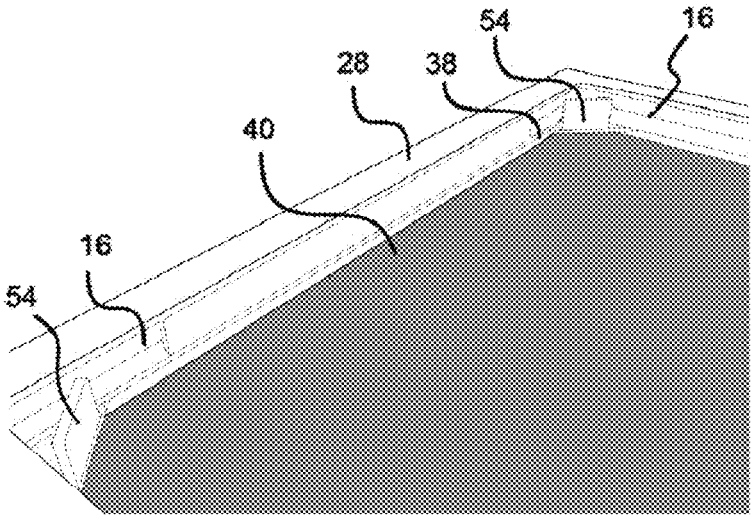
FIG. 19B is a rear perspective view of the exemplary display of FIG. 19A, showing the anchors slidably positioned within an opening of the frame to thereby support the backing in an operative position as disclosed herein.
Figure 20:
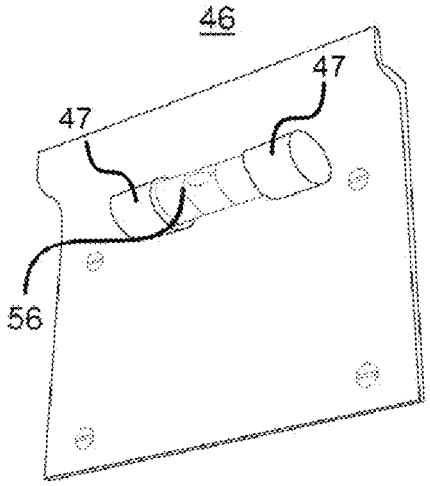
FIG. 20 is a perspective view of an exemplary support member having a leveling tool, wherein the support member is secured to a selected surface as disclosed herein.

In another exemplary aspect and with reference to FIG. 19A and FIG. 19B, the backing 40 can be secured in operative position by at least one anchor 54. In this aspect, at least a portion of the at least one anchor 54 can comprise a base portion having a substantially flat surface that can be positioned to be in contact with the backing 40. In a further aspect, at least a portion of the anchor 54 can be configured for attachment to a portion of the inner edge of the frame 12. It is contemplated that the at least one anchor 54 can be positioned at any location along the inner edge of the frame. In these aspects, the inner edge 16 of the frame 12 can define a first opening or slot 38 configured to receive at least a portion of the at least one anchor 54. In these aspects, at least a portion of the at least one anchor 54 can be slidably positioned relative to (and positioned within) the first opening or slot 38 of the inner edge 16 such that the flat surface of the anchor 54 overlies a portion of the backing 40 to thereby support the backing in an operative position. Preferably, the at least one anchor 54 can comprise a plurality of anchors positioned along the inner edge of the frame. In an optional aspect, the at least one anchor can comprise a base portion having two edges that can cooperate to define a point (e.g., a point formed by two perpendicular edges) such that the base portion of the at least one anchor 54 can be slidably positioned relative to (and positioned within) the first opening or slot 38 of the inner edge 16 at each corner of the frame, thereby supporting the backing in operative position. In use, it is contemplated that the point defined by the edges of the at least one anchor can have a complementary shape to a portion of a corner where respective edges of the frame meet. Optionally, in further aspects, it is contemplated that the at least one anchor 54 can comprise a tab portion that extends at an angle (e.g., an angle ranging from about 60 degrees to about 120 degrees and optionally being 90 degrees) relative to the base portion of the at least one anchor 54, thereby permitting gripping of the anchors during insertion and removal of the anchors from the first opening or slot 38.

In various aspects, and as shown in FIGS. 1-2B and 20-23, the system for displaying visual features disclosed herein can comprise at least one support member 46. It is contemplated that the at least one support member 46 can be configured to support the display assembly 10 in an operative position relative to a selected surface 48. Optionally, the at least one support member 46 can be configured to secure the display assembly 10 to the selected surface 48. Optionally, the at least one support member 46 can comprise a strut back, a stand, a metal tab, a hole, a bracket, a wire, a cleat, a plaque with at least one magnetic attachment point, or combinations thereof. In use, the at least one support member 46 can be secured to a wall surface where display assemblies are to be positioned. After the at least one support member 46 is secured to the wall surface, a first display assembly can be selectively positioned in engagement with the at least one support member, and then additional display assemblies can be coupled to the first display assembly as further disclosed herein. Optionally, in use, it is contemplated that the cover, visual features such as photographs, for example and without limitation, other display elements, and backing need not be inserted into the display assembly until the display assembly is properly engaged by the support member, thereby permitting visibility of the support member during the initial positioning of the display assembly. After proper positioning of the first display assembly is confirmed, then the cover, visual features, display elements and backing can be installed within the frame of the first display assembly such that the support member is no longer visible. Alternatively, in use, it is contemplated that the cover, visual features such as photographs, for example and without limitation, other display elements, and backing can be inserted into the display assembly prior to engagement of the display assembly by the support member. Prior to proper positioning of the first display assembly, the cover, visual features, display elements, and backing can be installed within the frame of the first display assembly, and then the first display assembly can be properly positioned in engagement with the at least one support member.

Figure 21A:
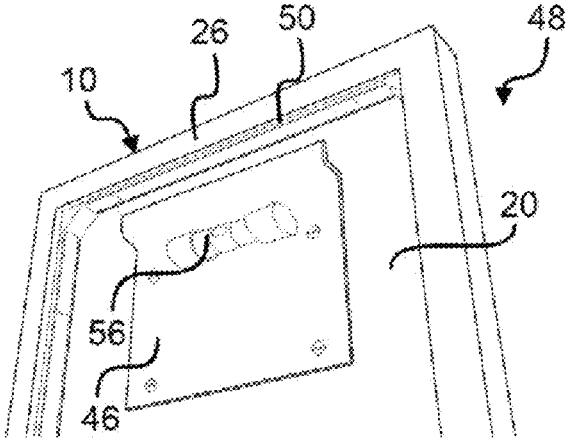
FIG. 21A is a front perspective view of an exemplary display assembly that is mounted onto the support member of FIG. 20 as disclosed herein.
Figure 21B:
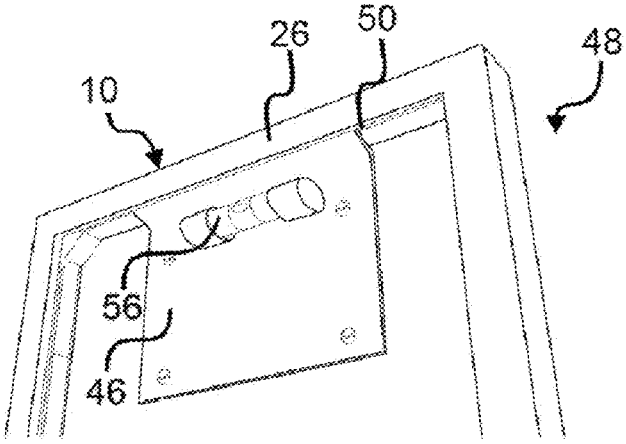
FIG. 21B is a front perspective view of the exemplary display assembly of FIG. 21A, showing the display assembly secured to the support member of FIG. 20 as disclosed herein.
Figure 22:
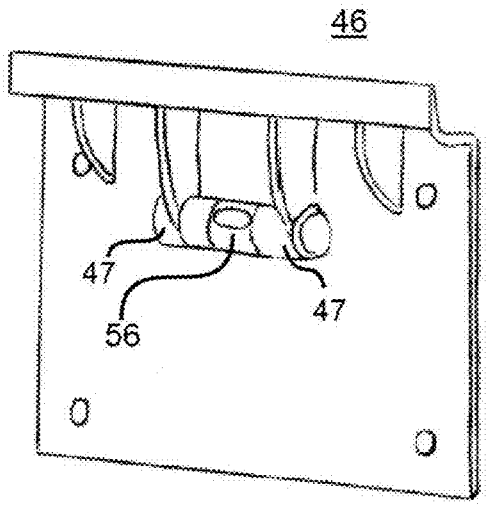
FIG. 22 is a perspective view of another exemplary support member as disclosed herein.
Figure 23:
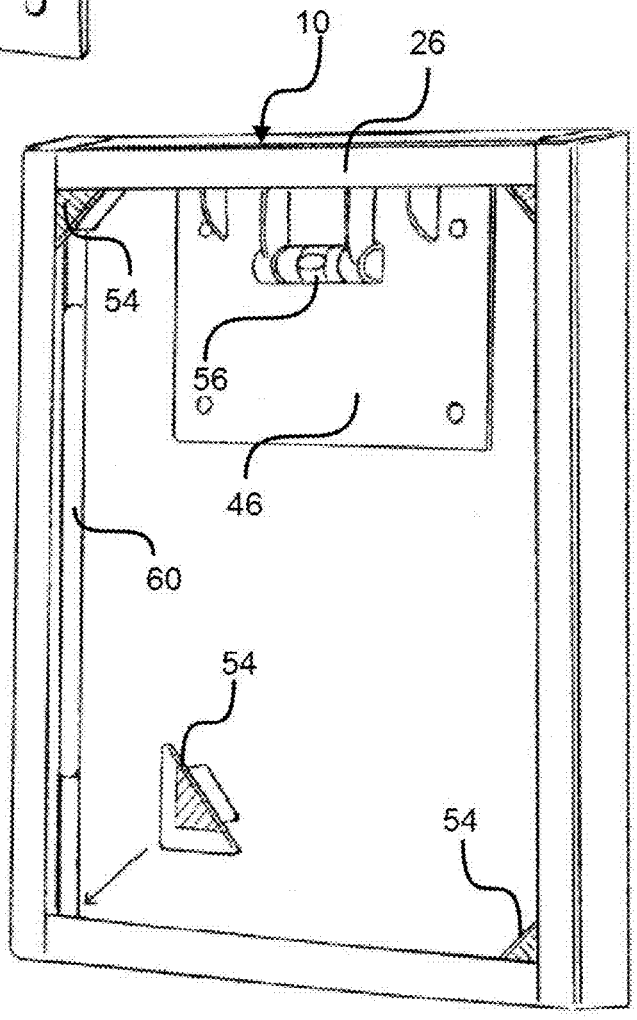
FIG. 23 is a front perspective view of an exemplary display assembly secured to the support member of FIG. 22 as disclosed herein.
Figure 24A:
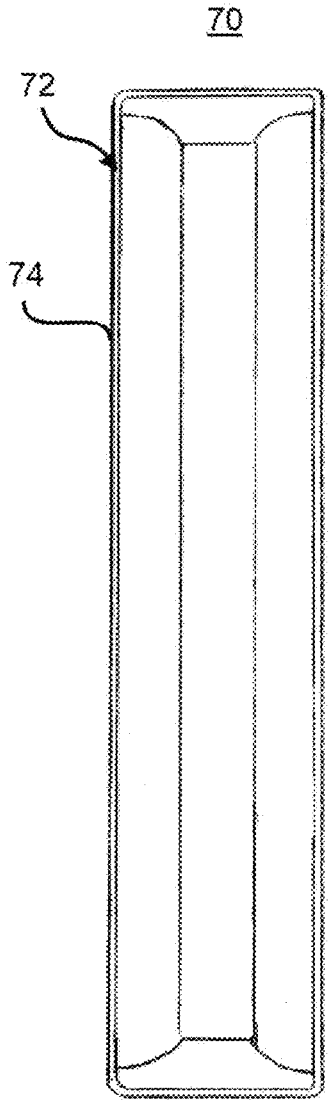
FIG. 24A is a top view of an exemplary spacer as described herein.
Figure 24B:
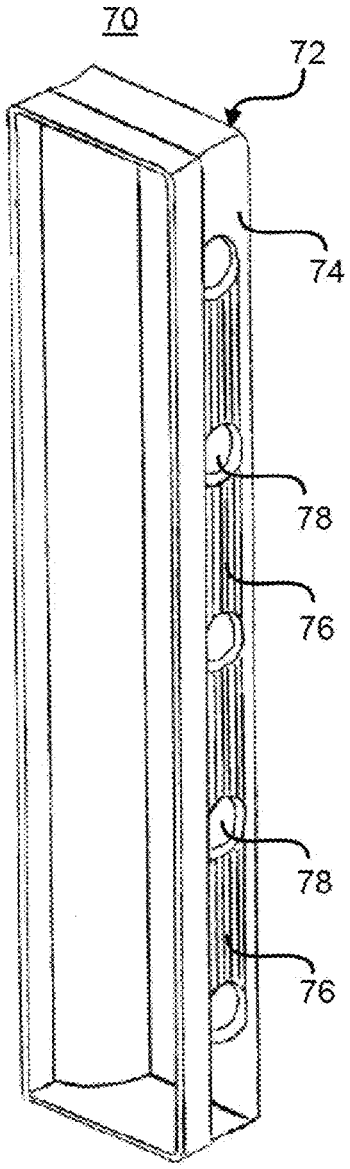
FIG. 24B is a side perspective view of the exemplary spacer of FIG. 24A, showing a plurality of recessed portions, each being configured to receive a magnet as disclosed herein.
Figure 25:
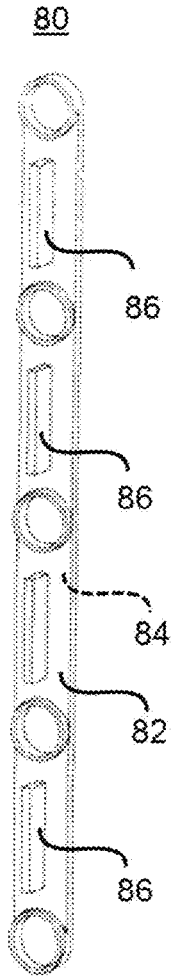
FIG. 25 is a perspective view of an exemplary spacer cover as disclosed herein.

In exemplary aspects, as shown in FIGS. 21A and 21B, the inner edge 16 of the frame 12 can define a second opening or slot 50 that can be configured to receive a portion of the at least one support member 46. In these aspects, it is contemplated that the at least one support member can comprise an upper portion that is configured for receipt within the second opening or slot 50. It is further contemplated that the upper portion can be recessed relative to lower portions of the support member such that the lower portions are substantially flush with a wall surface while the upper portion is spaced from the wall surface, thereby providing a space for receiving a portion of a frame as disclosed herein. Optionally, the at least one support member 46 can be configured for selective securement to a selected surface 48. In a further aspect, a portion of the at least one support member 46 can be slidably positioned relative to (and within) the second opening or slot 50, thereby supporting the display assembly in an operative position relative to the selected surface 48. In further exemplary aspects, it is contemplated that instead of providing a distinct second opening or slot 50, a portion of the at least one support member 46 can be slidably positioned relative to (and within) the first opening or slot 38.

Optionally, as further depicted in FIGS. 20-23, it is contemplated that the at least one support member 46 can comprise a leveling tool assembly 56 for level placement of the display assembly 10 onto a selected surface 48. In an exemplary aspect, the leveling tool assembly 56 can comprise at least one level vial (e.g., a level bubble vial) configured for selective coupling to the at least one support member 46. It is contemplated that the at least one level vial can be any conventional level vial known in the art. In a further exemplary aspect, the at least one support member 46 can define at least one support element 47 configured to receive and/or engage a portion of the at least one level vial, thereby supporting the at least one level vial in an operative (e.g., horizontal or vertical) position. In these aspects, the leveling tool assembly 56 can be securely fixed to a portion of the at least one support member 46. In another aspect, the leveling tool assembly 56 can be removably secured to at least a portion of the at least one support member 46. In exemplary non-limiting aspects, the at least one support element 47 can comprise first and second receptacles that extend outwardly from the support member 46 (away from the wall) to permit receipt of (and/or engagement with) a level vial as disclosed herein. However, it is contemplated that any conventional support or engagement mechanism, such as shelves, frictional engagement, adhesive, hook-and-loop fasteners, and the like can be used to secure the leveling tool assembly 56 to the support member 46. In use, it is contemplated that the leveling tool assembly 56 can allow for confirmation of proper orientation of the support member, thereby ensuring that the first display assembly secured to the support member and all display assemblies magnetically coupled to the first display assembly are also properly oriented.

Optionally, in another aspect, the display assembly 10 can comprise a cover (not shown). In one aspect, the cover can extend over at least a portion of the central opening 20 of the frame 12 of the display assembly 10. In another aspect, the cover can be substantially transparent. In another aspect, the cover can comprise plastic, glass, an acrylic material, acetate, or combinations thereof.

In one exemplary aspect, the cover can extend over at least a portion of the central opening 20 of the frame 12, and the front wall 42 of the backing 40 can be configured to support at least one visual feature of the plurality of visual features 22 within the central opening 20 of the frame 12. In this aspect, it is contemplated that the cover can be configured to permit viewing of the at least one visual feature 22 through the cover. In one aspect, the cover can be at least partially transparent. In another aspect, it is further contemplated that the cover can be plastic, glass, an acrylic material, acetate, or combinations thereof.

In another exemplary aspect, the display assembly 10 can comprise at least one display surface 52. In one aspect, the at least one display surface 52 can be configured for positioning in communication with (optionally, within) the central opening 20 of the frame 12. It is contemplated that the at least one display surface 52 can be configured to display at least one visual feature 22 of the plurality of visual features 22. It is further contemplated that the at least one display surface 52 can be operatively associated with the front wall 42 of the backing 40. In this aspect, the front wall 42 of the backing 40 can define the at least one display surface 52. Alternatively, in another aspect, the at least one display surface 52 can be secured to the front wall 42 of the backing 40. Optionally, in these aspects, the at least one display surface 52 can comprise a canvas, a chalkboard, a cork board, a bulletin board, a whiteboard, a magnetic board, drawing paper, or combinations thereof. It is contemplated that the canvas, the chalkboard, the cork board, the bulletin board, the whiteboard, the magnetic board, or the drawing paper can each have at least one magnet disposed on at least a portion of the board or material such that the board or material can establish a polar attraction with a magnet of at least one other board or material of the same or a different type of board or material. In other optional aspects, it is contemplated that at least a portion of the at least one display surface 52 can be defined by a digital display as further described herein.

In another aspect, the display assembly 10 can comprise at least one light source (not shown) configured to illuminate the at least one visual feature. In one aspect, the at least one light source can be disposed on at least a portion of the frame 12. In another aspect, the at least one light source can be positioned inside a light fixture. In this aspect, at least a portion of the light fixture can be configured to connect to at least a portion of the frame 12. In another aspect, the display assembly 10 can comprise a light box. It is contemplated that the light box can be an LED light box, a backlit light box or any other light box that is known in the art. It is further contemplated that the display assembly 10 can comprise a programmable circuit board disposed within at least a portion of the central opening 20. In another aspect, the display assembly 10 can comprise a stepper motor that can be connected to the circuit board. In this aspect, the circuit board can be used to control the stepper motor. For example, an Arduino circuit board, as is known in the art, can be used to control the stepper motor. It is contemplated that the circuit board can be programmed to control the brightness and color of the lights of the at least one light source. It is further contemplated that the circuit board can be programmed to turn the lights on and off.

In another aspect, it is contemplated that the circuit boards or other processing circuitry can be programmed to communicate (optionally, wirelessly communicate) with a computer or a remote computing device (e.g., a smartphone, PDA, tablet, and the like) such that a user can change the at least one visual feature to another at least one visual feature from a remote location. In this aspect, it is further contemplated that the disclosed system can comprise at least one wireless transmitter/receiver communicatively coupled with the processing circuitry to permit communication with the computer or remote computing device of the user. In yet another aspect, it is contemplated that the processing circuitry can be programmable or otherwise configured to: alter the arrangements of visual features displayed on a plurality of display assemblies; alter a display mode of selected groups of display assemblies (for example, from a first mode in which each display assembly displays a respective visual feature to a second mode in which each display assembly cooperates with other display assemblies to form a single visual feature); sequentially and cyclically display a sequence of visual features on one or more display assemblies; selectively adjust the light output (color, duration, etc.) of the light sources of one or more selected display assemblies, and the like.

In still a further aspect, it is contemplated that the processing circuitry can comprise a microcontroller that is preprogrammed with desired parameters for operation of the system such that input from a user is not required to initiate changes in display characteristics of the system.

In use, and as further disclosed herein, the display assembly 10 can be configured for selective positioning relative to at least one other display assembly to establish a polar attraction between aligned magnets associated with the frames of adjacent display assemblies. Optionally, in other exemplary aspects, it is contemplated that at least one display assembly 10 of the plurality of display assemblies can be spaced apart from at least one other display assembly using at least one spacer 70, as shown in FIGS. 24A-26B. In this aspect, the at least one spacer 70 can comprise a body 72 having an outer edge 74 that can define a perimeter of the body. In a further aspect, the outer edge 74 can comprise at least one recessed portion (receptacle) 78 configured to receive at least one magnet 30. In another aspect, the outer edge 74 can define at least one aperture or slot 76 configured to receive a connecting member 86 of a spacer cover 80. In one aspect, the at least one aperture 76 can extend inwardly from the outer edge 74 of the at least one spacer 70. In this aspect, the spacer cover 80 can have an inner surface 82 and an opposing outer surface 84. In these aspects, the at least one connecting member 86 can be disposed on a portion of the spacer cover 80. In one aspect, the at least one connecting member 86 can be disposed on the inner surface 82 of the spacer cover 80. Optionally, the at least one connecting member 86 of the spacer cover 80 can extend outwardly from the inner surface 82 of the spacer cover 80 for selective coupling to the at least one aperture or slot 76 of the at least one spacer 70. Alternatively, in an optional aspect, it is contemplated that the at least one connecting member 86 and the at least one aperture or slot 76 can be any conventional fasteners known in the art, including without limitation, dowels, inter-locking connecting shapes, adhesive, hook-and-loop fasteners, grommets, snaps, buttons, press studs, snap buttons and the like, that can be used to secure the at least one spacer cover 80 to the at least one spacer 70. In use, the at least one connecting member 86 of the spacer cover 80 can be coupled to the at least one aperture or slot 76 of the at least one spacer 70, thereby securing the spacer cover 80 to the outer edge 74 of the at least one spacer 70.

In another aspect, the at least one spacer 70 can comprise at least one magnet 30 that can be operatively associated with the body 72 of the at least one spacer. In one aspect, the at least one magnet 30 of the at least one spacer 70 can comprise one or more magnets that can be operatively associated with the outer edge 74 of the body 72. In another aspect, the at least one magnet 30 of the at least one spacer 70 can comprise one or more front magnets (not shown) that can be operatively associated with the front surface of the body 72 of the at least one spacer 70. In yet another aspect, the at least one magnet 30 of the at least one spacer 70 can comprise one or more rear magnets (not shown) that can be operatively associated with the back surface of the body 72 of the at least one spacer 70. Optionally, the at least one magnet 30 of the at least one spacer 70 can comprise both front and rear magnets as disclosed herein. It is contemplated that the at least one magnet 30 of the at least one spacer 70 can be embedded within the body 72 of the at least one spacer 70. Optionally, in one aspect, the at least one magnet 30 can comprise at least one magnet 30 (optionally, a dual polarity magnet 34 as further disclosed herein) positioned within the at least one recessed portion (receptacle) 78 defined within the body 72 of the at least one spacer 70.

In various exemplary aspects, it is contemplated that the at least one magnet 30 can comprise a plurality of magnets. In this aspect, the plurality of magnets can be spaced from one another about a portion of the body 72 of a spacer 70. Optionally, the plurality of magnets can be spaced apart from one another based on the relative proportional lengths of adjacent display assemblies. It is contemplated that such placement of the plurality of magnets can increase the number of center to center, and corner to corner attachment points between a spacer and a display assembly. For example and without limitation, the plurality of magnets 30 can be spaced a distance ranging from about 1 inch to about 2 inches from one another (i.e., each magnet is axially spaced from sequential magnets along the axial length of an edge of the spacer by a distance ranging from about 1 inch to about 2 inches). More particularly, the plurality of magnets 30 can be optionally spaced a distance of about 1.5 inches from one another. It is further contemplated, for example and without limitation, that when the body of a spacer 70 and the frame 12 of an adjacent display assembly 10 are coupled to one another such that the magnets of the spacer 70 are in communication with the magnets of the display assembly 10, the distance between corresponding (optionally, aligned) magnets of the coupled edges of the spacer and the display assembly can be in the range of about 1 inch to about 2 inches, or optionally about 1.5 inches. Optionally, it is contemplated that the magnets can be substantially centered relative to a width of each frame and each spacer (between the inner and outer edges of the frame and the spacer). It is further contemplated that the axial distance from a center point of each magnet to the inner and outer edges of the frame or spacer can range from about 0.5 to about 1.0 inches or, optionally, be about 0.75 inches.

In these aspects, the spacer cover 80 can be configured to secure the at least one magnet 30 in an operative position relative to the at least one recessed portion (receptacle) 78 of the spacer 70. In these aspects, the at least one spacer 70 can be configured for selective positioning between the frames of two adjacent display assemblies. In further aspects, the at least one spacer 70 can be operatively coupled to the outer edge 14 of each adjacent display assembly 10. In this aspect, the at least one magnet 30 associated with the at least one spacer 70 can be configured to establish a polar attraction between aligned magnets associated with the frames 12 of the adjacent display assemblies 10. It is contemplated that the spacers 70 can be selectively positioned adjacent any outer edge of the frames of the display assemblies disclosed herein. Optionally, each spacer can be dimensioned to extend along an entire axial length of a respective edge of an adjacent display assembly. However, as shown in FIG. 26B, it is also contemplated that each spacer can be dimensioned to extend along only a portion of the axial length of a respective edge of an adjacent display assembly.

Figure 28:
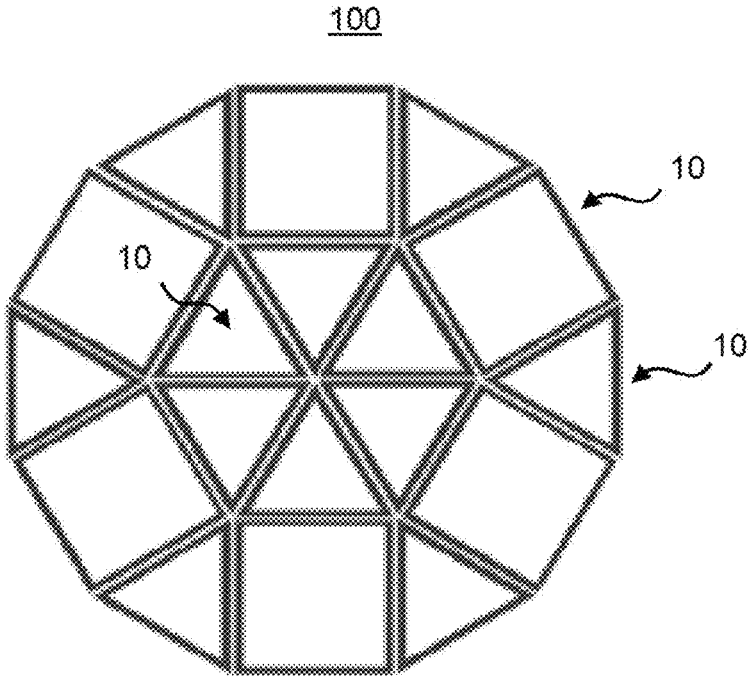
FIG. 28 is a front view of another exemplary configuration of a plurality of display assemblies, showing the frame of at least one display assembly having a different shape than the frame of another display assembly.
Figure 29:
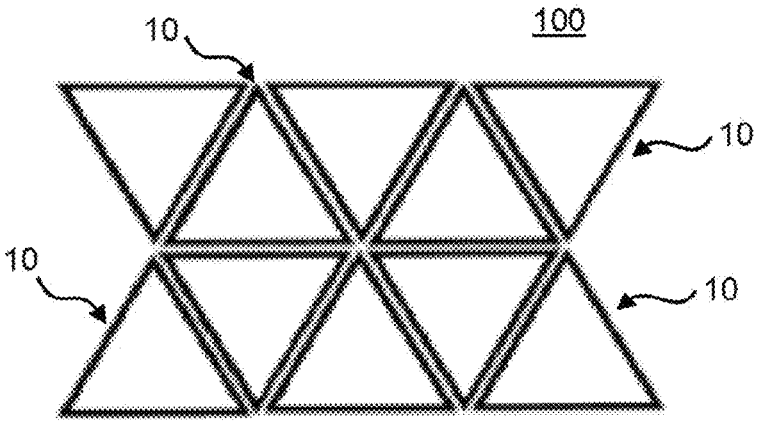
FIG. 29 is a front view of another exemplary configuration of a plurality of display assemblies.

In exemplary aspects, and with reference to FIGS. 3-11D, the display assemblies 10 disclosed herein can be used in a system 100 for selectively arranging a plurality of visual features 22. In one aspect, the system 100 can comprise a plurality of display assemblies 10. In one aspect, it is contemplated that the frame 12 of at least one display assembly 10 of the plurality of display assemblies can have a different shape than the frame 12 of at least one other display assembly of the plurality of display assemblies, as depicted in FIGS. 28 and 29. In another aspect, the frame 12 of at least one display assembly 10 of the plurality of display assemblies can have a different size than the frame 12 of at least one other display assembly of the plurality of display assemblies. In yet another aspect, the frame 12 of each display assembly 10 of the plurality of display assemblies can comprise a different color than the frame 12 of at least one other display assembly of the plurality of display assemblies. It is contemplated that the frame 12 of at least one display assembly 10 can be clear or translucent. In still a further aspect, the frame 12 of each display assembly 10 of the plurality of display assemblies can comprise a different material than the frame 12 of at least one other display assembly of the plurality of display assemblies. Alternatively, the frame 12 of each display assembly 10 of the plurality of display assemblies can comprise the same material. It is contemplated that the frame 12 of each display assembly 10 of the plurality of display assemblies can comprise wood, plastic, acrylic material, vinyl, fabric, metal, stone, or combinations thereof.

Referring now to FIGS. 3-11D and 26A-30, in one aspect, each display assembly 10 of the plurality of display assemblies of the system 100 can be configured for selective positioning relative to at least one other display assembly of the plurality of display assemblies to establish a polar attraction between aligned magnets associated with the frames of adjacent display assemblies. In one aspect, and with reference to FIGS. 3-9, the plurality of display assemblies 10 can comprise first and second display assemblies 10*a*, 10*b* having at least one magnet 30 operatively associated with the outer edge 14 of each frame 12 of the first and second display assemblies 10*a*, 10*b*. In this aspect, the at least one magnet 30 of the first display assembly 10*a* can be configured to establish a polar attraction with the at least one magnet 30 of the second display assembly 10*b*. In a further aspect, the system 100 can comprise a third display assembly 10*c* having at least one magnet 30 operatively associated with the back surface 28 of the frame 12 of the third display assembly 10*c*. In this aspect, the second display assembly 10*b* can have at least one magnet 30 operatively associated with the front surface 26 of the frame 12 of the second display assembly 10*b*, and the at least one magnet 30 on the front surface 26 of the second display assembly 10*b* can be configured to establish a polar attraction with the at least one rear magnet on the back surface 28 of the third display assembly 10*c*.

Optionally, in another aspect, the plurality of display assemblies 10 can comprise a first display assembly having at least one front magnet (not shown) operatively associated with the front surface 26 of the frame 12 of the first display assembly and a second display assembly having at least one rear magnet (not shown) operatively associated with the back surface 28 of the frame 12 of the second display assembly. In this aspect, the at least one front magnet of the first display assembly can be configured to establish a polar attraction with the at least one rear magnet of the second display assembly. Thus, it is not required that the display assemblies be positioned with their outer edges touching; it is contemplated that the system 100 can comprise display assemblies 10 that are only connected together through their front and back surfaces.

Figure 13B:
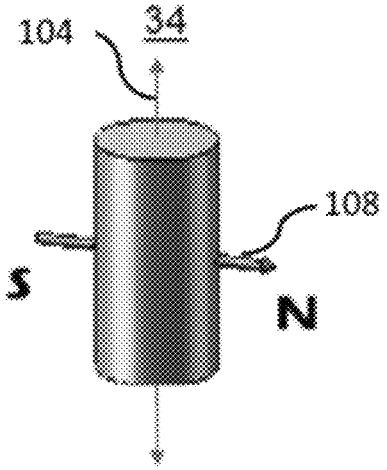
Figure 14:
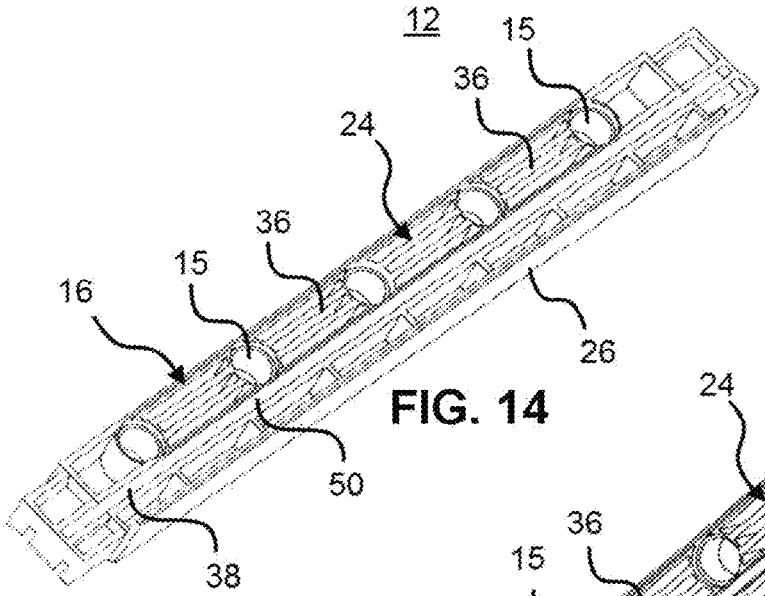
FIG. 14 is a side view of a portion of a frame of an exemplary display assembly, showing a housing defined within the frame and at least one receptacle defined within the housing.
Figure 15:
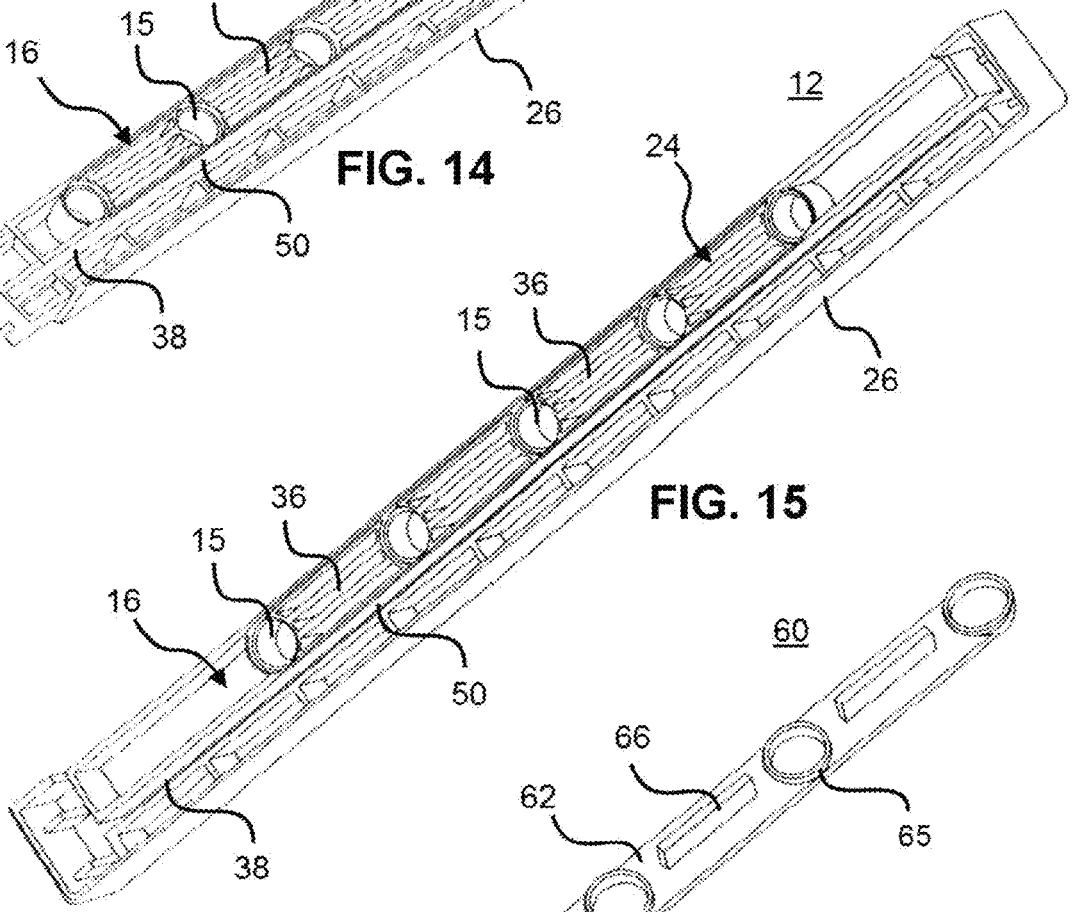
FIG. 15 is a side view of another portion of a frame of an exemplary display assembly, showing a housing defined within the frame and at least one receptacle defined within the housing.

With reference to FIGS. 13A-13B, in one aspect, the at least one magnet 30 of each display assembly 10 of the plurality of display assemblies can comprise at least one dual polarity magnet 34. It is contemplated that the at least one dual polarity magnet 34 can have an axial dual polarity. Alternatively, it is contemplated that the at least one dual polarity magnet 34 can have a diametric dual polarity. In one aspect, the plurality of display assemblies 10 can comprise first and second display assemblies having at least one dual polarity magnet 34. In this aspect, the at least one dual polarity magnet 34 of the first display assembly can automatically adjust its orientation to establish a polar attraction with the at least one dual polarity magnet 34 of the second display assembly.

In another aspect, as shown in FIG. 5, each display assembly 10 of the plurality of display assemblies of the system 100 can be configured for selective positioning relative to at least one other display assembly of the plurality of display assemblies using at least one fastener 32, as disclosed herein, that is associated with the frames of adjacent display assemblies. In one aspect, and with reference to FIG. 5, the plurality of display assemblies 10 can comprise first and second display assemblies 10*a*, 10*b* having at least one fastener 32 operatively associated with the outer edge 14 of each frame 12 of the first and second display assemblies 10*a*, 10*b*. In this aspect, the at least one fastener 32 of the first display assembly 10*a* can be configured to connect to the at least one fastener 32 of the second display assembly 10*b*. In a further aspect, the system 100 can comprise a third display assembly 10*c* having at least one fastener 32 operatively associated with the back surface 28 of the frame 12 of the third display assembly 10*c*. In this aspect, the second display assembly 10*b* can have at least one fastener 32 operatively associated with the front surface 26 of the frame 12 of the second display assembly 10*b*, and the at least one fastener 32 on the front surface 26 of the second display assembly 10*b* can be configured to connect to the at least one rear fastener 32 on the back surface 28 of the third display assembly 10*c*.

Optionally, in another aspect, the plurality of display assemblies 10 can comprise a first display assembly having at least one front fastener (not shown) operatively associated with the front surface 26 of the frame 12 of the first display assembly and a second display assembly having at least one rear fastener (not shown) operatively associated with the back surface 28 of the frame 12 of the second display assembly. In this aspect, the at least one front fastener of the first display assembly can be configured to connect to the at least one rear fastener of the second display assembly.

In exemplary aspects, it is contemplated that the display assemblies 10 disclosed herein can optionally comprise a combination of magnets and fasteners that are both operatively associated with the frames of the display assemblies as disclosed herein. Thus, in use, it is contemplated that at least one display assembly 10 of the plurality of display assemblies can comprise at least one magnet 30 and at least one fastener 32 as disclosed herein.

In one aspect, at least one display assembly 10 of the plurality of display assemblies can further comprise a backing 40 as further disclosed herein. In another aspect, the at least one display assembly 10 of the plurality of display assemblies can further comprise at least one support member 46 as further disclosed herein. It is contemplated that the at least one support member 46 can be configured to support the display assembly 10 in an operative position relative to a selected surface 48. It is further contemplated that the at least one support member 46 can be configured to secure the display assembly 10 to a selected surface 48. In one aspect, the at least one support member 46 can comprise a strut back, a stand, a metal tab, a hole, a bracket, a wire, a cleat, a plaque with at least one magnetic attachment point, or combinations thereof. In exemplary aspects, the at least one support member 46 of a first display assembly of the system 100 can be configured to provide support for the first display assembly as well as the other display assemblies of the system. Thus, in these aspects, it is contemplated that only a single display assembly 10 of the system 100 need comprise a support member 46. More generally, in exemplary aspects, at least one display assembly 10 of the system 100 does not comprise a support member 46.

In another exemplary aspect, at least one display assembly 10 of the plurality of display assemblies can comprise at least one display surface 52. In one aspect, the at least one display surface 52 can be configured for positioning with the central opening 20 of the frame 12. It is contemplated that the at least one display surface 52 can be configured to display at least one visual feature 22 of the plurality of visual features 22. It is further contemplated that the at least one display surface 52 can be operatively associated with the front wall 42 of the backing 40. In this aspect, the front wall 42 of the backing 40 can define the at least one display surface 52. Alternatively, in another aspect, the at least one display surface 52 can be secured to the front wall 42 of the backing 40. Optionally, in these aspects, the at least one display surface 52 can comprise a canvas, a chalkboard, a cork board, a bulletin board, a whiteboard, a magnetic board, drawing paper, or combinations thereof. In exemplary aspects, it is contemplated that at least one display assembly 10 of the system 100 can have a different display surface than at least one other display assembly of the system. It is further contemplated that the canvas, the chalkboard, the cork board, the bulletin board, the whiteboard, the magnetic board, or the drawing paper can each have at least one magnet disposed on at least a portion of the board or material such that the board or material can establish a polar attraction with a magnet of at least one other board or material of the same or a different type of board or material.

Optionally, in exemplary aspects, the outer surfaces of the frames of display assemblies 10 of the display systems 100 disclosed herein can be selectively provided with one or more surface treatments to vary the texture of connecting surfaces within the system. In various aspects, the surface treatments can be configured to increase the strength of attachment and/or fixation of each frame relative to adjacent frames of the system. For example, in one aspect, at least a portion of an outer surface of the frame of one display assembly can have a rubberized or roughened texture that increases the frictional engagement with an adjacent surface of the frame of a second display assembly. In this aspect, it is contemplated that the increased frictional engagement between the adjacent frames can make it more difficult (require more force) to move the frames relative to one another. In exemplary aspects, corresponding outer surfaces of the frames of a plurality of adjacent display assemblies within a system can be provided with similar surface treatments to increase frictional engagement throughout the display system.

In use, the display assemblies and systems disclosed herein can be used in a method for selectively arranging a plurality of visual features 22. In various aspects, the method can comprise positioning a plurality of display assemblies onto a surface 48. In one aspect, and with reference to FIGS. 11A-11D, it is contemplated that the surface can be a horizontal surface. Alternatively, in another aspect, and with reference to FIGS. 3-10, it is contemplated that the surface can be a vertical surface. In other aspects, the method can comprise selectively arranging each display assembly 10 of the plurality of display assemblies relative to at least one other display assembly, as shown in FIGS. 3-11D. It is contemplated that each display assembly 10 of the plurality of display assemblies can be configured for selective positioning relative to at least one other display assembly of the plurality of display assemblies to establish a polar attraction between aligned magnets associated with the frames of adjacent display assemblies. In another aspect, it is contemplated that each display assembly 10 of the plurality of display assemblies can be configured for selective positioning relative to at least one other display assembly of the plurality of display assemblies to connect to at least one fastener 32 associated with the frames of adjacent display assemblies.

Figure 3:
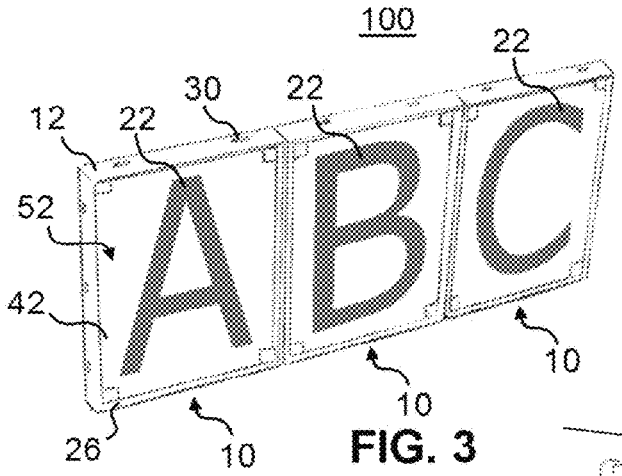
FIG. 3 is a front perspective view of an exemplary configuration of a plurality of display assemblies, showing each display assembly selectively positioned relative to at least one other display assembly and having magnetically connected outer surfaces as disclosed herein.
Figure 4:
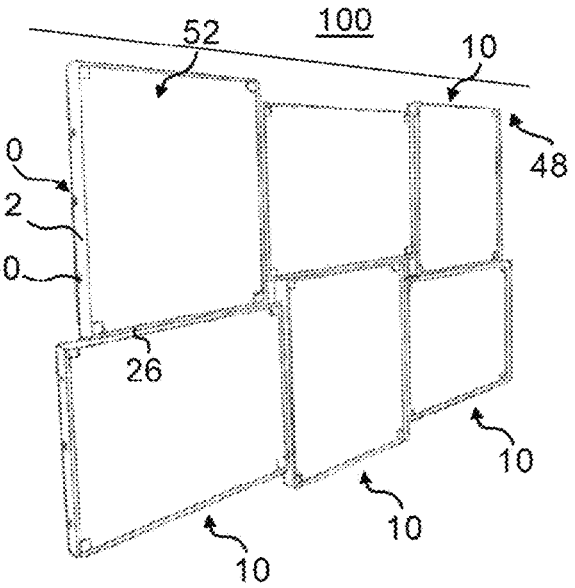
FIG. 4 is a front perspective view of another exemplary configuration of a plurality of display assemblies, showing each display assembly selectively positioned relative to at least one other display assembly and having magnetically connected outer surfaces as disclosed herein.
Figure 10:
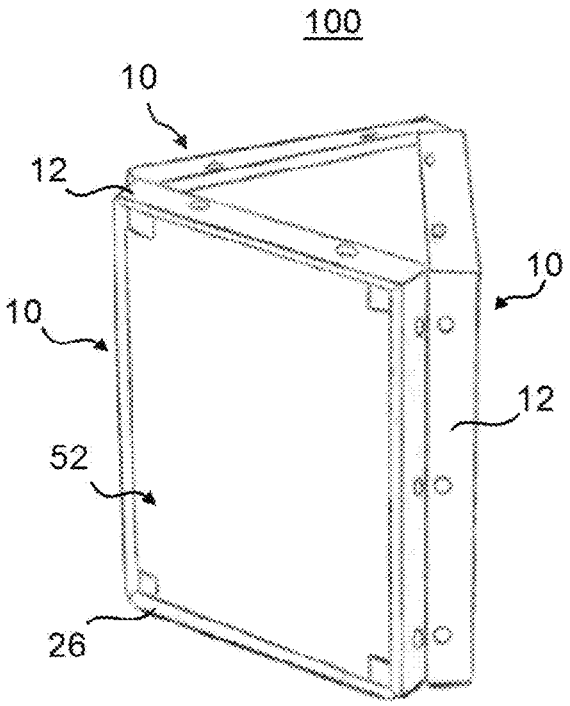
FIG. 10 is a perspective view of an exemplary folded configuration of three magnetically connected display assemblies as disclosed herein.

In one exemplary method, a display system 100 can be formed by arranging three substantially equally sized display assemblies 10 in a side-by-side configuration as shown in FIG. 3. In this exemplary method, it is contemplated that the display assemblies 10 can be rotated relative to one another to produce a display system having a triangular cross-sectional shape as shown in FIGS. 10-11D. It is further contemplated that the magnetic attraction between adjacent outer edges of the three display assemblies can be maintained as the display assemblies are rotated relative to each other. It is still further contemplated that upon rotation of the three display assemblies the magnetic attraction between adjacent outer edges of the display assemblies can be maintained even though the magnets of the respective display assemblies are not in contact with one another. For example, as shown in FIG. 10, it is contemplated that aligned magnets can be visibly spaced from one another while still maintaining a sufficient magnetic attraction to support the display assemblies in a desired folded configuration.

Figure 30:
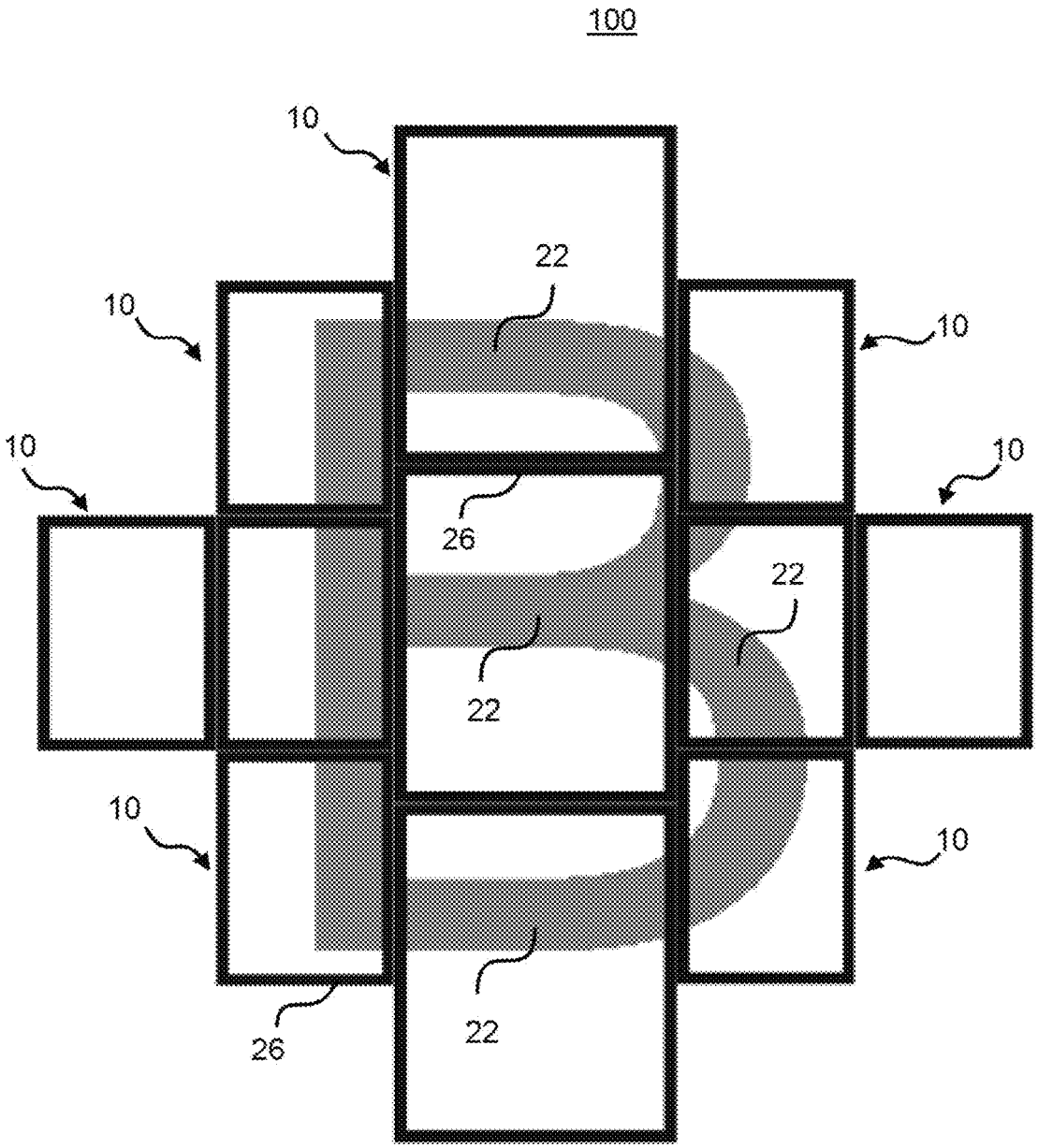
FIG. 30 is a front view of another exemplary configuration of a plurality of display assemblies, showing a visual feature spanning the plurality of display assemblies to represent an enlarged photo display. As shown, it is contemplated that the plurality of display assemblies can cooperate to display respective portions of a selected display pattern, with the portions displayed on the plurality of display assemblies cooperating to produce the selected display pattern.

In further exemplary aspects, it is contemplated that a display system can be formed with a plurality of display assemblies having digital displays as further disclosed herein. In these aspects, it is contemplated that the digital displays of the plurality of display assemblies can cooperate to produce a desired visual effect. For example, it is contemplated that each respective digital display can be configured to display a portion of an image, with the digital displays cooperating to display the entire image, as shown in FIG. 30. Thus, it is further contemplated that the display assemblies can be selectively positioned relative to one another to ensure that the digital displays are properly oriented relative to one another to achieve the desired visual effect. It is still further contemplated that the timing of the display of visual features on each digital display can be coordinated with the timing of the display of visual features on other digital displays of the display system to achieve the desired visual effect. For example, a digital display of a first display assembly can be configured to transition from displaying a first image to displaying a second image at a selected time, and a digital display of a second display assembly can be configured to transition from displaying a third image to displaying a fourth image at the selected time, thereby coordinating the transitioning of displayed images among the display assemblies. It is contemplated that conventional image processing software can be used to determine the configuration and size of each image with respect to the configuration and size of a corresponding display assembly.

Kits

Packaging kits comprising articles of manufacture, devices and systems of the present disclosure are described herein. The kits can comprise, for example, at least one display assembly having a frame 12 and at least one frame cover 60 as described herein. The kits can further comprise at least one magnet 30, at least one fastener 32, or combinations thereof. The kits can also comprise at least one cover (not shown) and at least one backing 40 as described herein. In another aspect, the kits can comprise at least one anchor 54 as described herein. The kits can further comprise at least one support member 46 as described herein. In another aspect, the kits can comprise at least one fastener (not shown) for mounting the at least one support member 46 to a selected surface, including without limitation, a nail, a screw, a bolt, or the like. Optionally, the kits can comprise at least one spacer 70 and at least one spacer cover 80 as described herein. The kits can further comprise instructions for assembling the parts of the display assembly 10 together as described herein. In another aspect, the kits can comprise instructions for attaching, securing or connecting a support member 46 to a selected surface 48 as described herein. In a further aspect, the kits can comprise instructions for attaching, connecting, securing or mounting the display assembly to the support member 46 or to a selected surface 48 as described herein. In still further aspects, the kit can comprise instructions for adhering, attaching or connecting, the display assembly 10 to at least one other display assembly in some manner or fashion that meets the goals and advantages of the present technology described herein. In additional optional aspects, the kit can comprise a container (e.g., a box) that encloses the described products and that can be selectively opened to provide access to the products.

Exemplary Aspects

Aspect 1: A system for selectively arranging a plurality of visual features, comprising: a plurality of display assemblies, each display assembly of the plurality of display assemblies comprising: a frame having an outer edge and an inner edge, wherein the outer edge of the frame defines a perimeter of the frame, wherein the inner edge of the frame defines a central opening that is configured to receive at least one visual feature of the plurality of visual features; and at least one magnet operatively associated with the frame, wherein each display assembly of the plurality of display assemblies is configured for selective positioning relative to at least one other display assembly of the plurality of display assemblies to establish a polar attraction between aligned magnets associated with the frames of adjacent display assemblies.

Aspect 2: The system of aspect 1, wherein at least one display assembly of the plurality of display assemblies further comprises a backing having a front wall and an opposed back wall, wherein at least a portion of the backing is configured for selective operative coupling to the frame of a respective display assembly, and wherein, upon operative coupling of the backing to the frame of the display assembly, at least a portion of the backing is positioned in communication with the central opening.

Aspect 3: The system of any one of the preceding aspects, further comprising at least one support member configured to support the display assembly in an operative position relative to a selected surface.

Aspect 4: The system of any one of the preceding aspects, wherein the at least one support member is configured to secure the display assembly to a selected surface.

Aspect 5: The system of any one of the preceding aspects, wherein the at least one support member comprises a strut back, a stand, a metal tab, a hole, a bracket, a wire, a cleat, a plaque with at least one magnetic attachment point, or combinations thereof.

Aspect 6: The system of any one of the preceding aspects, wherein at least one display assembly of the plurality of display assemblies further comprises a cover extending over at least a portion of the central opening of the frame of the at least one display assembly.

Aspect 7: The system of any one of the preceding aspects, wherein the cover is substantially transparent.

Aspect 8: The system of any one of the preceding aspects, wherein the cover comprises plastic, glass, an acrylic material, acetate, or combinations thereof.

Aspect 9: The system of any one of the preceding aspects, wherein at least one display assembly of the plurality of display assemblies further comprises a cover extending over at least a portion of the central opening of the frame of the at least one display assembly, wherein the front wall of the backing is configured to support at least one visual feature of the plurality of visual features within the central opening of the frame, and wherein the cover is configured to permit viewing of the at least one visual feature through the cover.

Aspect 10: The system of any one of the preceding aspects, wherein the cover is at least partially transparent.

Aspect 11: The system of any one of the preceding aspects, wherein the cover comprises plastic, glass, an acrylic material, acetate, or combinations thereof.

Aspect 12: The system of any one of the preceding aspects, wherein at least one display assembly of the plurality of display assemblies comprises at least one display surface configured for positioning within the central opening of the frame and configured to display at least one visual feature of the plurality of visual features.

Aspect 13: The system of any one of the preceding aspects, wherein the at least one display surface comprises a canvas, a chalkboard, a cork board, a bulletin board, a whiteboard, a magnetic board, drawing paper, or combinations thereof.

Aspect 14: The system of any one of the preceding aspects, wherein at least one display assembly of the plurality of display assemblies further comprises at least one display surface configured to display at least one visual feature of the plurality of visual features, and wherein the at least one display surface is operatively associated with the front wall of the backing.

Aspect 15: The system of any one of the preceding aspects, wherein the front wall of the backing defines the at least one display surface, and wherein the at least one display surface comprises a canvas, a chalkboard, a cork board, a bulletin board, a whiteboard, a magnetic board, drawing paper, or combinations thereof.

Aspect 16: The system of any one of the preceding aspects, wherein the at least one display surface is secured to the front wall of the backing, and wherein the least one display surface comprises a canvas, a chalkboard, a cork board, a bulletin board, a whiteboard, a magnetic board, drawing paper, or combinations thereof.

Aspect 17: The system of any one of the preceding aspects, wherein the at least one magnet of at least one display assembly comprises one or more magnets that are operatively associated with the outer edge of the frame of each respective display assembly of the at least one display assembly.

Aspect 18: The system of any one of the preceding aspects, wherein the frame of each display assembly of the plurality of display assemblies has a front surface and an opposed back surface, and wherein each of the front and back surfaces of the frame of each display assembly extends between the inner and outer edges of the frame of the display assembly.

Aspect 19: The system of any one of the preceding aspects, wherein the at least one magnet of at least one display assembly comprises one or more magnets that are operatively associated with the front surface of the frame of each respective display assembly of the at least one display assembly.

Aspect 20: The system of any one of the preceding aspects, wherein the at least one magnet of at least one display assembly comprises one or more magnets that are operatively associated with the back surface of the frame of each respective display assembly of the at least one display assembly.

Aspect 21: The system of any one of the preceding aspects, wherein the at least one magnet of at least one display assembly of the plurality of display assemblies is embedded within the frame of the at least one display assembly of the plurality of display assemblies.

Aspect 22: The system of any one of the preceding aspects, wherein the plurality of display assemblies comprises first and second display assemblies having at least one magnet operatively associated with the outer edge of each frame of the first and second display assemblies, wherein the at least one magnet of the first display assembly is configured to establish a polar attraction with the at least one magnet of the second display assembly.

Aspect 23: The system of any one of the preceding aspects, wherein the plurality of display assemblies comprises a first display assembly having at least one front magnet operatively associated with the front surface of the frame of the first display assembly and a second display assembly having at least one rear magnet operatively associated with the back surface of the frame of the second display assembly, and wherein the at least one front magnet of the first display assembly is configured to establish a polar attraction with the at least one rear magnet of the second display assembly.

Aspect 24: The system of any one of the preceding aspects, further comprising a third display assembly having at least one rear magnet operatively associated with the back surface of the frame of the third display assembly, wherein the second display assembly has at least one front magnet operatively associated with the front surface of the frame of the second display assembly, and wherein the at least one front magnet on the front surface of the second display assembly is configured to establish a polar attraction with the at least one rear magnet on the back surface of the third display assembly.

Aspect 25: The system of any one of the preceding aspects, wherein the frame of at least one display assembly of the plurality of display assemblies has a different shape than the frame of at least one other display assembly of the plurality of display assemblies.

Aspect 26: The system of any one of the preceding aspects, wherein the frame of at least one display assembly of the plurality of display assemblies has a different size than the frame of at least one other display assembly of the plurality of display assemblies.

Aspect 27: The system of any one of the preceding aspects, wherein the frame of each display assembly of the plurality of display assemblies comprises wood, plastic, acrylic, vinyl, fabric, metal, stone, or combinations thereof.

Aspect 28: The system of any one of the preceding aspects, wherein the at least one magnet of each display assembly of the plurality of display assemblies comprises at least one dual polarity magnet.

Aspect 29: The system of any one of the preceding aspects, wherein the at least one dual polarity magnet comprises a plurality of dual polarity magnets.

Aspect 30: The system of any one of the preceding aspects, wherein the at least one magnet of each display assembly of the plurality of display assemblies comprises at least one single polarity magnet.

Aspect 31: A method for selectively arranging a plurality of visual features, the method comprising: positioning a plurality of display assemblies onto a surface, each display assembly of the plurality of display assemblies comprising: a frame having an outer edge and an inner edge, wherein the outer edge of the frame defines a perimeter of the frame, and wherein the inner edge of the frame defines a central opening, wherein the central opening is configured to receive at least one visual feature of the plurality of visual features; and at least one magnet operatively associated with the frame; and selectively arranging each display assembly of the plurality of display assemblies relative to at least one other display assembly, wherein each display assembly of the plurality of display assemblies is configured for selective positioning relative to at least one other display assembly of the plurality of display assemblies to establish a polar attraction between aligned magnets associated with the frames of adjacent display assemblies.

Aspect 32: The method of aspect 31, wherein the surface is a horizontal surface.

Aspect 33: The method of any one of the preceding aspects, wherein the surface is a vertical surface.

Aspect 34: The method of any one of the preceding aspects, wherein the frame of each display assembly of the plurality of display assemblies has a front surface and an opposed back surface, each of the front and back surfaces extending between the inner and outer edges of the frame of each display assembly.

Aspect 35: The method of any one of the preceding aspects, wherein the at least one magnet of at least one display assembly comprises one or more front magnets that are operatively associated with the front surface of the frame of each display assembly of the at least one display assembly.

Aspect 36: The method of any one of the preceding aspects, wherein the at least one magnet of at least one display assembly comprises one or more rear magnets that are operatively associated with the back surface of the frame of each display assembly of the at least one display assembly.

Aspect 37: The method of any one of the preceding aspects, wherein the plurality of display assemblies comprises first and second display assemblies having at least one magnet operatively associated with the outer edge of each frame of the first and second display assemblies, and wherein the at least one magnet of the first display assembly establishes a polar attraction with the at least one magnet of the second display assembly.

Aspect 38: The method of any one of the preceding aspects, wherein the plurality of display assemblies comprises a first display assembly having at least one front magnet operatively associated with the front surface of the frame of the first display assembly and a second display assembly having at least one rear magnet operatively associated with the back surface of the frame of the second display assembly, wherein the at least one front magnet of the first display assembly establishes a polar attraction with the at least one rear magnet of the second display assembly.

Aspect 39: The method of any one of the preceding aspects, further comprising a third display assembly having at least one rear magnet operatively associated with the back surface of the frame of the third display assembly, wherein the second display assembly has at least one front magnet operatively associated with the front surface of the frame of the second display assembly, and wherein the at least one front magnet on the front surface of the second display assembly establishes a polar attraction with the at least one rear magnet on the back surface of the third display assembly.

Aspect 40: The method of any one of the preceding aspects, wherein the at least one magnet of each display assembly of the plurality of display assemblies comprises at least one dual polarity magnet.

Aspect 41: The method of any one of the preceding aspects, wherein the at least one dual polarity magnet comprises a magnet having an axial dual polarity.

Aspect 42: The method of any one of the preceding aspects, wherein the at least one dual polarity magnet comprises a magnet having a diametric dual polarity.

Aspect 43: The method of any one of the preceding aspects, wherein the plurality of display assemblies comprise first and second display assemblies having at least one dual polarity magnet, wherein the at least one dual polarity magnet of the first display assembly automatically adjusts its orientation to establish a polar attraction with the at least one dual polarity magnet of the second display assembly.

Aspect 44: A display assembly, comprising: a frame having an outer edge and an inner edge, wherein the outer edge of the frame defines a perimeter of the frame, and wherein the inner edge of the frame defines a central opening, wherein the central opening is configured to receive at least one visual feature of a plurality of visual features; and at least one magnet operatively associated with the frame, wherein the display assembly is configured for selective positioning relative to at least one other display assembly to establish a polar attraction between aligned magnets associated with the frames of adjacent display assemblies.

Aspect 45: The display assembly of aspect 44, wherein the at least one magnet comprises at least one dual polarity magnet.

Aspect 46: The display assembly of any one of the preceding aspects, wherein the at least one dual polarity magnet comprises a magnet having an axial dual polarity.

Aspect 47: The display assembly of any one of the preceding aspects, wherein the at least one dual polarity magnet comprises a magnet having a diametric dual polarity.

Aspect 48: The display assembly of any one of the preceding aspects, wherein the at least one magnet comprises at least one single polarity magnet.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A system for selectively arranging a plurality of visual features, comprising:

a plurality of display assemblies, each display assembly of the plurality of display assemblies comprising:

a frame having a plurality of adjoining frame portions, each frame portion having an outer edge and an inner edge, wherein the outer edges of the adjoining frame portions define a perimeter of the frame, wherein the inner edges of the adjoining frame portions define a central opening that is configured to receive at least one visual feature of the plurality of visual features; and a plurality of dual-polarity magnets positioned within the frame, each dual-polarity magnet having axially opposed poles along a polar axis and opposing planar faces spaced relative to the polar axis, wherein at least one dual polarity magnet is positioned within each frame portion, wherein the frame defines a plurality of receptacles within which a respective dual polarity magnet is received, each receptacle being shaped to provide sufficient clearance to allow a corresponding dual polarity magnet to flip about a flipping axis that is transverse to the polar axis to thereby reverse its operative polarity in response to a polarity of an external magnetic force in proximity to the corresponding dual polarity magnet, wherein the receptacles define respective voids within which a respective dual-polarity magnet of the plurality of dual-polarity magnets flips; and wherein each display assembly of the plurality of display assemblies is configured for selective positioning relative to at least one other display assembly of the plurality of display assemblies to establish a polar attraction between aligned magnets associated with the frames of adjacent display assemblies, wherein each dual-polarity magnet of the plurality of frames is configured to adjust its operative polarity depending upon a polarity of aligned magnets associated with adjacent display assemblies, wherein at least one display assembly of the plurality of display assemblies further comprises at least one support member configured to engage a portion of the frame of the display assembly, wherein the at least one support member is configured to be secured to a selected surface to thereby support the display assembly in an operative position relative to the selected surface.

2. The system of claim 1, wherein at least one display assembly of the plurality of display assemblies further comprises a backing having a front wall and an opposed back wall, wherein at least a portion of the backing is configured for selective operative coupling to the frame of a respective display assembly, and wherein, upon operative coupling of the backing to the frame of the display assembly, at least a portion of the backing is positioned in communication with the central opening.

3. The system of claim 2, wherein at least one display assembly of the plurality of display assemblies further comprises at least one display surface configured to display at least one visual feature of the plurality of visual features, and wherein the at least one display surface is operatively associated with the front wall of the backing.

4. The system of claim 3, wherein the front wall of the backing defines the at least one display surface, and wherein the at least one display surface comprises a canvas, a chalkboard, a cork board, a bulletin board, a whiteboard, a magnetic board, drawing paper, or combinations thereof.

5. The system of claim 3, wherein the at least one display surface is secured to the front wall of the backing, and wherein the least one display surface comprises a canvas, a chalkboard, a cork board, a bulletin board, a whiteboard, a magnetic board, drawing paper, or combinations thereof.

6. The system of claim 1, wherein the support member is configured to support the display assembly in an operative position relative to a wall surface; and wherein the support member is configured to secure the display assembly to the wall surface.

7. The system of claim 1, wherein at least one display assembly of the plurality of display assemblies comprises at least one display surface configured for positioning within the central opening of the frame and configured to display at least one visual feature of the plurality of visual features.

8. The system of claim 1, wherein the plurality of dual-polarity magnets of at least one display assembly comprises one or more magnets that are operatively associated with the outer edge of at least one frame portion of the frame of each respective display assembly of the at least one display assembly.

9. The system of claim 1, wherein the frame of each display assembly of the plurality of display assemblies has a front surface and an opposed back surface, and wherein each of the front and back surfaces of the frame of each display assembly extends between the inner and outer edges of the frame portions of the frame of the display assembly.

10. The system of claim 9, wherein the plurality of dual-polarity magnets of at least one display assembly comprises one or more magnets that are operatively associated with the front surface of the frame of each respective display assembly of the at least one display assembly.

11. The system of claim 9, wherein the plurality of dual-polarity magnets of at least one display assembly comprises one or more magnets that are operatively associated with the back surface of the frame of each respective display assembly of the at least one display assembly.

12. The system of claim 9, wherein the plurality of display assemblies comprises first and second display assemblies having at least one dual-polarity magnet operatively associated with the outer edge of at least one frame portion of the frames of the first and second display assemblies, wherein the at least one magnet that is operatively associated with the outer edge of the first display assembly is configured to establish a polar attraction with the at least one magnet that is operatively associated with the outer edge of the second display assembly.

13. The system of claim 12, further comprising a third display assembly having at least one rear magnet operatively associated with the back surface of the frame of the third display assembly, wherein the second display assembly has at least one front magnet operatively associated with the front surface of the frame of the second display assembly, and wherein the at least one front magnet on the front surface of the second display assembly is configured to establish a polar attraction with the at least one rear magnet on the back surface of the third display assembly.

14. The system of claim 9, wherein the plurality of display assemblies comprises a first display assembly having at least one front magnet operatively associated with the front surface of the frame of the first display assembly and a second display assembly having at least one rear magnet operatively associated with the back surface of the frame of the second display assembly, and wherein the at least one front magnet of the first display assembly is configured to establish a polar attraction with the at least one rear magnet of the second display assembly.

15. The system of claim 1, wherein at least one frame has a rectangular shape, and wherein each adjoining frame portion of the rectangular frame defines a side of the rectangular shape.

16. A kit comprising:

a system as recited in claim 1, wherein the plurality of display assemblies comprises a first display assembly, and wherein the first display assembly comprises a support member configured to engage a portion of the frame of the center display assembly, wherein the support member is configured to be secured to a selected surface to thereby support the first display assembly in an operative position relative to the selected surface;

at least one fastener configured to secure the support member to the selected surface;

a backing configured for insertion within the central opening of the frame of the first display assembly, wherein the backing is configured to support at least one visual feature within the central opening of the frame of the first display assembly; and a cover configured for placement over the central opening of the frame of the first display assembly, wherein the cover is configured to permit viewing of the at least one visual feature supported within the central opening of the frame of the first display assembly, wherein additional display assemblies of the plurality of display assemblies are configured for magnetic coupling to the first display assembly.

17. The system of claim 1, wherein said at least one display assembly comprises a first display assembly, wherein the plurality of display assemblies further comprises a second display assembly that does not comprise a support member, wherein the polar attraction between the aligned magnets associated with the frames of the first and second display assemblies is sufficient to maintain the second display assembly in a first operative position relative to the selected surface via the at least one support member of the first display assembly, wherein the first display assembly comprises a level tool, and wherein the level tool is configured to enable leveling of the second display assembly via the magnetic coupling of the second display assembly to the first display assembly.

18. A method for selectively arranging a plurality of visual features, the method comprising:

positioning a plurality of display assemblies onto a surface, each display assembly of the plurality of display assemblies comprising:

a frame having a plurality of adjoining frame portion, each frame portion having an outer edge and an inner edge, wherein the outer edges of the adjoining frame portions define a perimeter of the frame, and wherein the inner edges of the adjoining frame portions define a central opening, wherein the central opening is configured to receive at least one visual feature of the plurality of visual features; and a plurality of dual-polarity magnets positioned within the frame, each dual-polarity magnet having axially opposed poles along a polar axis and opposing planar faces spaced relative to the polar axis, wherein at least one dual polarity magnet is positioned within each frame portion, wherein the frame defines a plurality of receptacles within which a respective dual polarity magnet is received, each receptacle being shaped to provide sufficient clearance to allow a corresponding dual polarity magnet to flip about a flipping axis that is transverse to the polar axis to thereby reverse its operative polarity in response to a polarity of an external magnetic force in proximity to the corresponding dual polarity magnet, wherein the receptacles define respective voids within which a respective dual-polarity magnet of the plurality of dual-polarity magnets flips; and selectively arranging each display assembly of the plurality of display assemblies relative to at least one other display assembly, wherein at least one display assembly of the plurality of display assemblies further comprises at least one support member configured to engage a portion of the frame of the at least one display assembly, wherein the at least one support member is configured to be secured to a selected surface to thereby support the at least one display assembly in an operative position relative to the selected surface.

19. A display assembly, comprising:

a frame having a rectangular shape and a plurality of adjoining frame portions, each frame portion defining a side of the rectangular shape and having an outer edge and an inner edge, wherein the outer edges of the adjoining frame portions of the frame define a perimeter of the frame, and wherein the inner edges of the adjoining frame portions of the frame define a central opening, wherein the central opening is configured to receive at least one visual feature; and a plurality of dual-polarity magnets positioned within the frame, each dual-polarity magnet having axially opposed poles along a polar axis and opposing planar faces spaced relative to the polar axis, wherein at least one dual polarity magnet is positioned within each frame portion, wherein the frame defines a plurality of receptacles within which a respective dual polarity magnet is received, each receptacle being shaped to provide sufficient clearance to allow a corresponding dual polarity magnet to flip about a flipping axis that is transverse to the polar axis to thereby reverse its operative polarity in response to a polarity of an external magnetic force in proximity to the corresponding dual polarity magnet, wherein the receptacles defines respective voids within which a respective dual-polarity magnet of the plurality of dual-polarity magnets flips; and at least one support member configured to engage a portion of the frame of the display assembly, wherein the at least one support member is configured to be secured to a selected surface to thereby support the display assembly in an operative position relative to the selected surface, wherein the display assembly is configured for selective positioning relative to at least one other display assembly to establish a polar attraction between magnets associated with the frames of adjacent display assemblies.

* * * * *